United States Patent [19]

Sjogren et al.

[11] 4,037,525

[45] July 26, 1977

[54] SIGNATURE STACKER EMPLOYING SWINGABLE INTERCEPT MEANS DRIVEN IN A NON-LINEAR FASHION

[75] Inventors: Christer A. Sjogren, Miami, Fla.; Ralph H. Backman, Taby, Sweden

[73] Assignee: EDS, Inc., Hialeah Gardens, Fla.

[21] Appl. No.: 600,491

[22] Filed: July 30, 1975

[51] Int. Cl.[2] ..... B31B 1/98

[52] U.S. Cl. ..... 93/93 C; 93/93 R; 271/189

[58] Field of Search ..... 93/93 C, 93 DP, 93 R; 271/189, 192, 229, 245, 256

[56] References Cited

U.S. PATENT DOCUMENTS

| | | | |
|---|---|---|---|
| 2,819,661 | 1/1958 | Howdle et al. | 93/93 DP |
| 3,306,173 | 2/1967 | Robinson | 93/93 DP |
| 3,479,932 | 11/1969 | Stal et al. | 93/93 DP |
| 3,526,170 | 9/1970 | Oderman et al. | 93/93 DP |
| 3,617,055 | 11/1971 | Stal | 93/93 DP X |
| 3,772,972 | 11/1973 | Dutro et al. | 93/93 C |
| 3,908,985 | 9/1975 | Wiseman | 271/189 |

*Primary Examiner*—James F. Coan

[57] ABSTRACT

A signature stacker having an infeed section for receiving a continuous stream of signatures arranged in overlapping fashion to form either compensated or uncompensated bundles having a predetermined and precise number of signatures. Counter means in the infeed section counts each signature in the stream to generate a signal upon accumulation of a predetermined count to activate a retractable stop means which enables a preloaded swingable intercept blade to be abruptly urged into the path of the signature stream which is passing from the infeed conveyor towards a reciprocating blade assembly. The signatures for the bundle being completed are deposited by a downwardly moving reciprocating stacking blade assembly upon the bundle holding bucket of an outfeed assembly, said intercept blade passing through the intercept region for a period sufficient to enable the stacking blade assembly to move downwardly to deposit a completed bundle (or bundle portion) and to return to the uppermost position in readiness for receiving the next group of signatures.

26 Claims, 29 Drawing Figures

130
130a
130b
130c
130d
131
132
136
136a
139
139a
139b
141
141a
141b
137
137a
137b
137c
137d
137e
140
2d
2h
D
R 110
111
112
113
115
116
117
120
120a
120b
121
122
123
124
12
103
104a, b
105
105a
105b
105'
125
127

SIGNATURE STACKER EMPLOYING SWINGABLE INTERCEPT MEANS DRIVEN IN A NON-LINEAR FASHION

BACKGROUND OF THE INVENTION

The present invention relates to signature stackers and more particularly to a novel stacker for forming either compensated or non-compensated bundles of a predetermined bundle size wherein the otherwise conventional means employed in present day stackers which serve to momentarily hold a portion of the signature stream in a stationary position is eliminated through the use of a novel swingable intercept assembly driven into rotation by non-linear drive means.

Stackers are typically used in the graphic arts industry wherein it is desired to form bundles of signatures such as, for example, magazines, newspapers and the like, wherein each bundle is comprised of a predetermined number of signatures. Signatures are typically delivered to the stacker in a continuous stream and are arranged in overlapping fashion. The delivery rate of signatures such as, for example, newspapers delivered from the press room, is typically in excess of 70,000 signatures per hour. It is therefore necessary to provide a stacker which is capable of separating the continuous stream into accurate size bundles and wherein stacking is performed at speeds sufficient to eliminate the need for slowing down the flow rate of signatures from the presses.

Conventional stackers are typically comprised of an infeed conveyor section which receives the signatures and which, in turn, is provided with means for counting the signatures as they pass therethrough. Some means must then be provided for intercepting the stream of signatures at a location intermediate the infeed and outfeed conveyors, at which latter location the signatures are neatly stacked into a bundle. One conventional type of intercept means is comprised of a plurality of buckets arranged at spaced intervals along a pair of closed loop chains driven so that while one bucket receives signatures from the incoming stream, at least one other bucket is locked into a non-intercept position in readiness for moving into the signature stream when the bundle on the moving bucket is completed.

The bucket receiving signatures is moved in a downward direction and continues to accumulate signatures until the predetermined bundle size is achieved, at which time the aforesaid counter means provides a trigger signal for unlatching the latched bucket thereby moving the unlatched bucket into the signature stream to begin a new bundle. Stackers of this type have been found to limit maximum bundle size for the reasons set forth, for example, in U.S. Pat. No. 3,479,932. In order to overcome the disadvantageous feature of limiting maximum bundle size a technique is described in the aforementioned U.S. Patent wherein two separate and independent sets of buckets are arranged on separate closed loop chain pairs and are independently driven to permit independent relative motion between the two sets of buckets arranged at intervals along their associated chain pairs. This technique, however, provides a quite complicated and expensive stacker structure.

Still another technique utilized in conventional stackers employs holding means provided in the in-feed conveyor section, which functions to hold or "clamp" the signature stream passing therethrough so as to introduce a gap in the signature stream for a time interval of a duration sufficient to permit the reciprocating stacker assembly to deliver the completed bundle to a bucket at the outfeed conveyor location and to return to its uppermost position in readiness for receiving signatures to form the next bundle. This technique has been found to be disadvantageous due to the fact that signatures (especially when still wet) have been found to curl or fold over as a result of the abrupt clamping operation so as to damage the clamped signatures, as well as the signatures immediately following the clamped signatures and to effect the neatness of the bundles being formed, as well as creating a potential jam condition.

BRIEF DESCRIPTION OF THE INVENTION

This invention is characterized by providing a novel intercept technique and apparatus for use in stackers and the like and which avoids all of the shortcomings and complexities of conventional stackers while providing a novel stacking assembly capable of forming either compensated or uncompensated bundles of accurate bundle size and thereby eliminating the need for a multiplicity of stacker baskets and/or clamping means utilized in conventional stackers.

The novel stacker of the present invention is provided with an infeed conveyor section adapted to impart stiffness to signatures of the incoming stream to facilitate handling thereof. Counter means are provided within the in-feed to count signatures and to develop a trigger signal upon reaching a predetermined count which serves to activate single revolution clutch means after a predetermined delay period and to further activate an intercept stop means to release a swingable intercept blade enabling the intercept blade to abruptly move into the incoming signature stream as the last bundle has been completed and to capture and temporarily hold signatures intercepted by said swingable blade means for a period of time sufficient to permit the reciprocating stacking blade assembly to move downwardly to deposit the last formed bundle or bundle portion to the bucket assembly and return to its uppermost position in readiness for receiving the signatures forming the next bundle.

The swingable intercept blade assembly is driven by a novel one revolution clutch means and acceleration/deceleration unit adapted to impart a gradually and smoothly increasing and then decreasing non-linear angular velocity to the swingable intercept blade, thereby facilitating the intercept operation. The swingable blade assembly is provided with self-contained torsion spring means for preloading the swingable portion to abruptly intercept the signature stream, said torsion spring device being provided with adjustable pre-tensioning means. Maximum torque protection clutch means are provided to prevent both the intercept blade and its cooperating stop means from being damaged or broken. A one-way clutch assembly is provided to prevent any bouncing or rebounding of the swingable intercept blade in a direction which would effect the desired movement of the signature stream during an intercept operation.

The reciprocating stacking blade assembly is movable between an uppermost and lowermost position. Stationary back-stop means cooperates with the stacking blade assembly of the stacker to cause the bundle (or bundle portion) to be deposited into a rotatable bundle receiving bucket.

In cases where signatures of large bundle size are being formed, it is preferred to form compensated bundles. For example, in instances where a bundle of 50 signatures is to be formed, it is preferable to stack 25 signatures into the bucket and then rotate the bucket through one-half of a full revolution before receiving the remaining 25 signatures so that the bottom 25 signatures have their spines (folded edges) facing in a first direction while the remaining 25 signatures have their spines facing in the opposite direction, thereby forming a bundle whose top-most signature is substantially level. Means are thus provided for rotating the bucket upon its turn-table to form such compensated bundles.

Once a bundle of either the compensated or uncompensated type has been formed, means must now be provided for rapidly moving or pushing the completed bundle out of the bucket in a time period which is short enough in duration so as not to require any reduction in the operating speeds of incoming stream to the intercept blade assembly and/or the stacking blade assembly. These objectives are accomplished by the provision of pneumatically driven pusher means which is programmable to either push all completed bundles out of the holding bucket in a first direction or, alternatively, to push completed bundles out of the holding bucket in either one of two opposite directions so as to push alternating bundles onto out-feed conveyor means positioned on opposite sides of the holding bucket, or alternatively to push bundles out of the holding bucket in any desired pattern be it a regular or irregular pattern.

The pusher means is comprised of novel pneumatucally driven carrier means movable along a guide shaft and having a pusher arm secured thereto. The pusher arm moves horizontally to engage one side of a completed bundle and push the bundle out of the holding bucket and on to a receiving conveyor assembly.

In applications where alternating bundles are to be pushed out of the holding bucket in alternately opposing directions, the movement of the pneumatically driven pusher arm assembly to one extreme end point of its horizontal line of travel automatically pre-positions the pusher arm for pushing out the next bundle. However, in applications where successive bundles are to be pushed out of the holding bucket and onto a single receiving conveyor, means are provided for sensing the position of the pusher arm in order to return the pusher arm to the same extreme end point of its travel at a more rapid rate than the rate of movement of the pusher arm during the time at which it is pushing a bundle out of the holding bucket, to thereby return the pusher arm to its starting point before the next bundle is transferred to the holding bucket.

BRIEF DESCRIPTION OF THE FIGURES AND OBJECTS

It is therefore one object of the present invention to provide a novel swingable intercept blade means for stackers and the like which is adapted to be periodically and intermittently rotated through one full revolution and at a non-linear angular velocity for intercepting a signature stream for a time duration sufficient to deliver the last completed bundle or bundle portion from a stacking blade assembly to a holding bucket.

Another object of the present invention is to provide a novel swingable intercept blade assembly for use in stackers and the like wherein an intercept blade periodically rotates through one full revolution, starting initially at zero velocity Another object of the present invention is to provide a novel swingable intercept blade assembly for use in stackers and the like wherein an intercept blade periodically rotates through one full revolution, starting initially at almost zero velocity and returning to the starting point substantially simultaneously with the reduction of the angular velocity to a substantially zero value to present breakage of either the intercept blade assembly and/or its associated reciprocating intercept stop member.

Still another object of the present invention is to provide a novel swingable intercept blade assembly having pre-loading means for assuring abrupt movement of the intercept blade into the incoming signature steam upon release of the intercept stop assembly.

Still another object of the present invention is to provide a novel swingable intercept blade assembly for use in signature stackers and the like and which is provided with maximum torque protection means to prevent the intercept blade assembly and/or its cooperating intercept stop from being damaged.

Still another object of the present invention is to provide a novel swingable blade assembly for use in signature stackers and the like and which includes one-way clutch assembly means to prevent rebounding in a first angular direction so as to avoid interference of the intercept blade assembly with the signature stream as signatures are being delivered to the interecept blade assembly.

Still another object of the present invention is to provide a swingable blade assembly for use in signature stackers and the like which is driven by novel single revolution clutch means and non-linear acceleration/deceleration drive means operated by said single revolution clutch means to impart a non-linear angular velocity to the intercept blade means during an intercept operation.

Still another object of the present invention is to provide a novel pusher assembly for use in signature stackers and the like and which is programmable to push completed bundles in either of two directions in alternating or non-alternating fashion.

Still another object of the present invention is to provide a novel pusher assembly for use in signature stackers and the like and which is adapted to push bundles from a bundle holding bucket to a receiving conveyor means wherein means are provided for returning the pusher assembly to an initial start position at a velocity significantly greater than the velocity imparted to the pusher member when pushing a bundle from the bundle holding bucket to the receiving conveyor.

The above as well as other objects of the present invention will become apparent when reading the accompanying description and drawings in which:

FIG. 1*a* is a side elevational view of the stacker designed in accordance with the principles of the present invention:

FIG. 1*b* shows an elevational view of the stacker of FIG. 1*a* looking in the direction of arrows 1*b*, 1*b;*

FIG. 2*a* is an elevational view of the swingable intercept blade assembly and drive means therefor utilized in the stacker of FIG. 1*a;*

FIG. 2*b* shows a view of the assembly of FIG. 2*a* looking in the direction of arrows 2*b* —2*b*, wherein portions of the intercept assembly have been sectionalized;

FIG. 2*c* shows a top view, partially sectionalized, of the blade holder of FIG. 2*b*.

FIG. 2*d* shows a sectional view of the blade holder of FIG. 2*c* looking in the direction of arrows 2*d* —2*d*.

FIGS. 2*e* -2*l* show a view of the elements which comprise the adjustment assembly for adjusting the torsional force applied to the blade holder by torsion spring of FIG. 2*b*.

FIG. 2*m* shows a detailed sectional veiw of the maximum torque protection clutch assembly employed in the intercept assembly of FIGS. 2*a* and 2*b*;

FIG. 3*a* shows an elevational view of the infeed section of the stacker of FIG. 1*a*;

FIG. 3*b* shows a view of the infeed section of FIG. 3*a* , looking in the direction of arrows 3*b* —3*b*;

FIG. 3*c* shows an elevational view of the infeed section of FIG. 3*a*, looking in the direction of arrows 3*c* —3*c*;

FIG. 3*d* shows a view of the speed sensing device employed in the infeed conveyor section and looking in the direction of arrows 3*d* —3*d* of FIG. 3*c*;

FIGS. 4*a*, 4*b* and 4*c* are top, side elevational and rear elevational views of the intercept stop assembly employed at the downstream end of the infeed section of FIGS. 3*a* -3*c*, FIG. 4*b* further showing the manner in which the intercept blade assembly cooperates with the intercept stop;

FIG. 5*a* shows an elevational view of the stacking blade assembly employed in the stacker of FIG. 1*a*;

FIG. 5*b* shows a top plan view of the stacking blade assembly of FIG. 5*a*;

FIGS. 6*a* and 6*d* are side elevational and top plan views of the outfeed assembly showing the rotatable turntable and holding bucker assembly;

FIGS. 7*a* and 7*b* are end and side elevational views respectively of the pusher arm assembly utilized for pushing completed bundles out of the holding bucket assembly of FIGS. 6*a* and 6*b* and onto appropriate receiving conveyors;

FIG. 7*c* is a detailed view of the air inlet and quick release ports used with the pusher assembly of FIGS. 7*a* and 7*b*.

DETAILED DESCRIPTION OF THE INVENTION

Figure 1B:
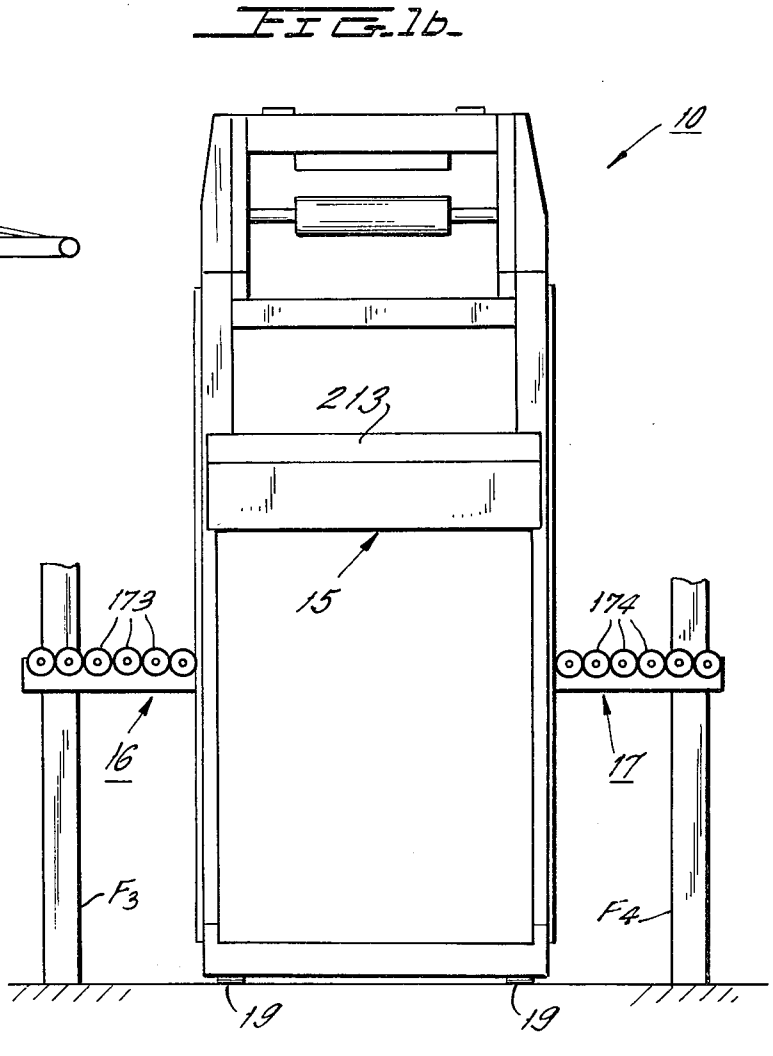
Figure 1A:
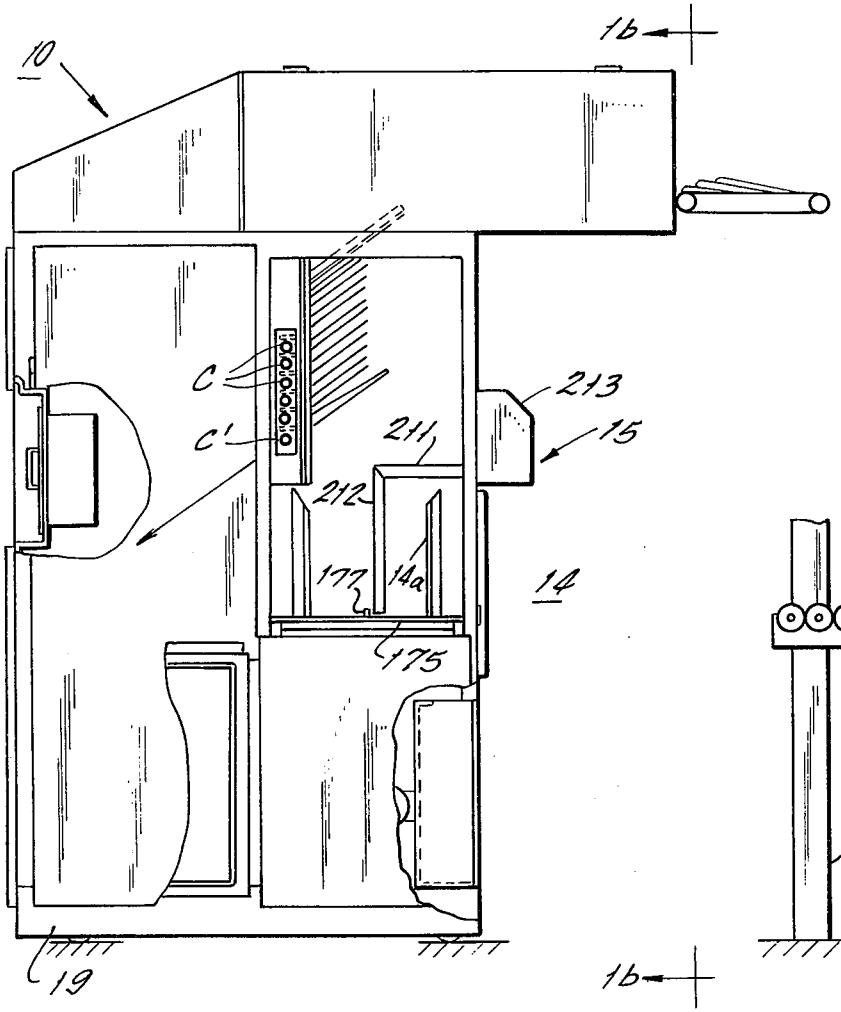

FIGS. 1*a* and 1*b* show a stacker 10 designed in accordance with the principles of the present invention and comprised of an infeed section 11 which has its right-hand end (relative to FIG. 1*a*) abutting against a signature stream conveyor means (not shown, for purposes of simplicity) which delivers a stream of signatures arranged in overlapping fashion to the stacker 10.

The signature stream moves from right to left (relative to FIG. 1*a*) through the infeed assembly whereupon each of the individual signatures are counted by suitable counter means arranged within the infeed section (and to be more fully described hereinbelow) which counting means serves to provide a trigger signal after reaching a predetermined count to activate the swingable intercept blade assembly 12, so as to move the blade assembly into the path of the incoming signature stream and thereby temporarily support at least a few of the signatures for a time duration sufficient in length to permit the previous completed bundle collected upon the stacking blade assembly 13 to be delivered into a holding bucket assembly 14 having upright side walls 14*a* and 14*b* for holding and neatly stacking the signatures delivered thereto.

The holding bucket assembly 14 is mounted upon a turntable (to be more fully described) which is activated when it is desired to form compensated bundles. Once a completed bundle (of either the compensated or non-compensated type) is stacked within the holding bucket assembly 14, pusher assembly 15 is activated to move in a linear fashion across the holding bucket assembly and between upright side walls 14*a* and 14*b* to engage one side of a stacked bundle and push the bundle out of the table assembly and onto one of the left or right-hand receiving conveyor assemblies 16 or 17, the pusher assembly 15 being programmable to push successive bundles onto receiving conveyor 17, or alternating bundles respectively onto receiving conveyors 16 and 17, in an alternating and regular pattern or in a substantially alternating and irregular pattern.

The remaining portions of the stacker housing serve to house various components of the stacker assembly, such as the electrical and electronic circuits, power supplied pneumatic devices and controls (C), and the like. The stacker is preferably mounted upon wheels 19 to facilitate movement of the stacker to an appropriate stacking location.

Figure 3A:
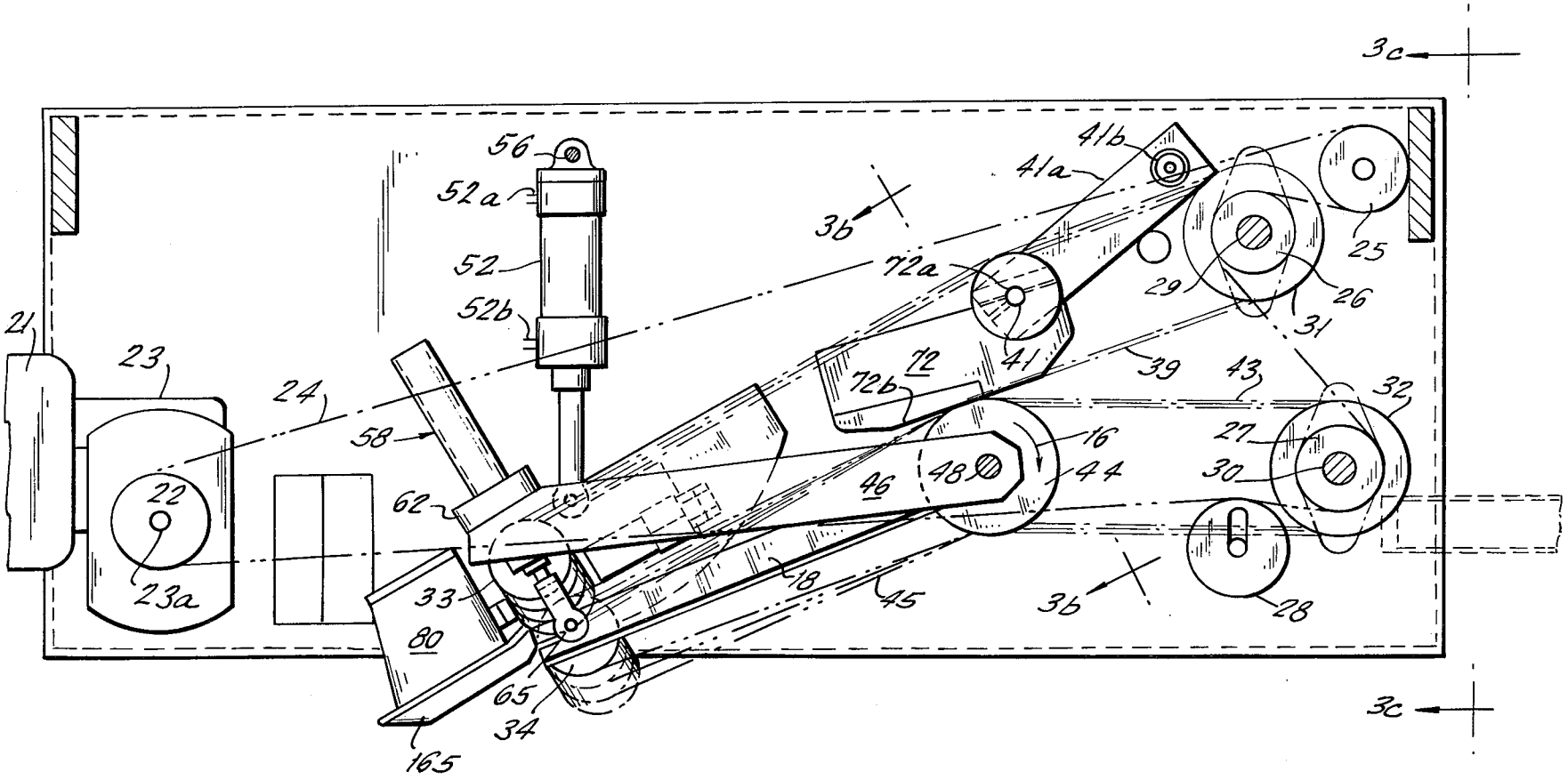
Figure 3B:
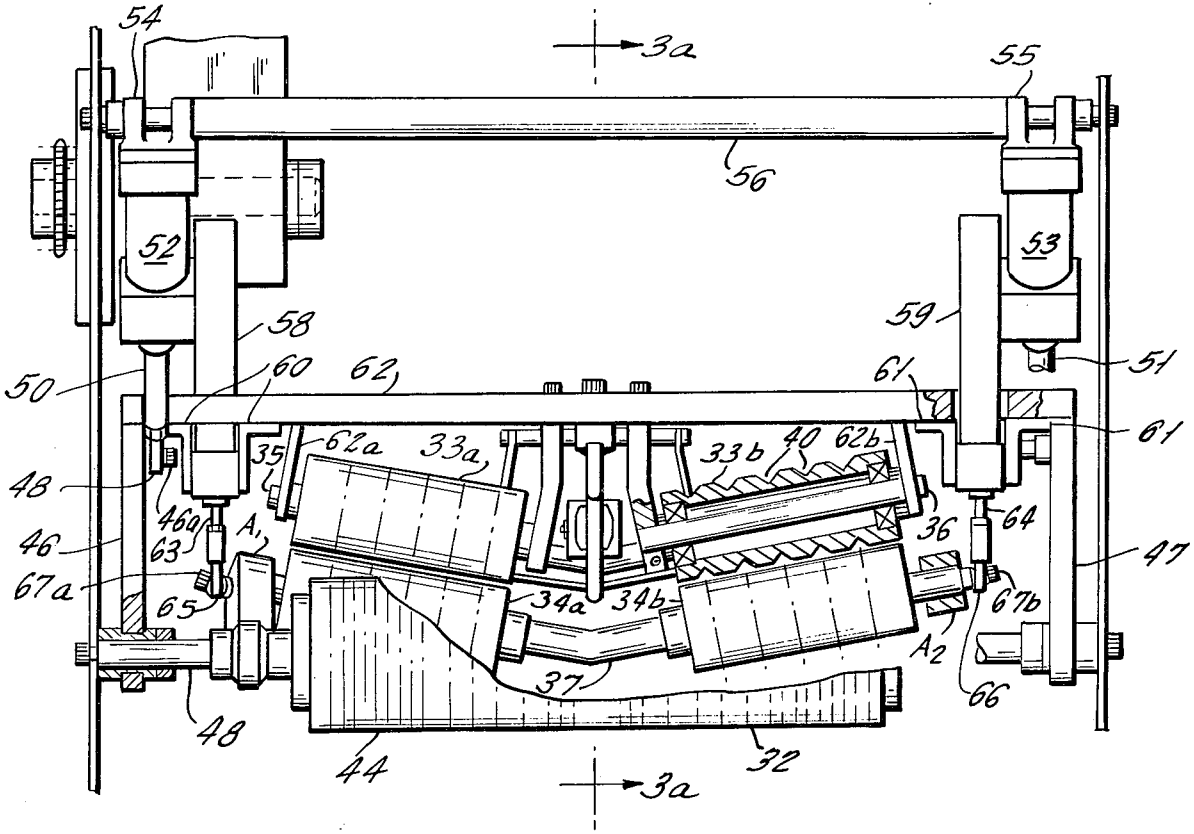
Figure 3C:
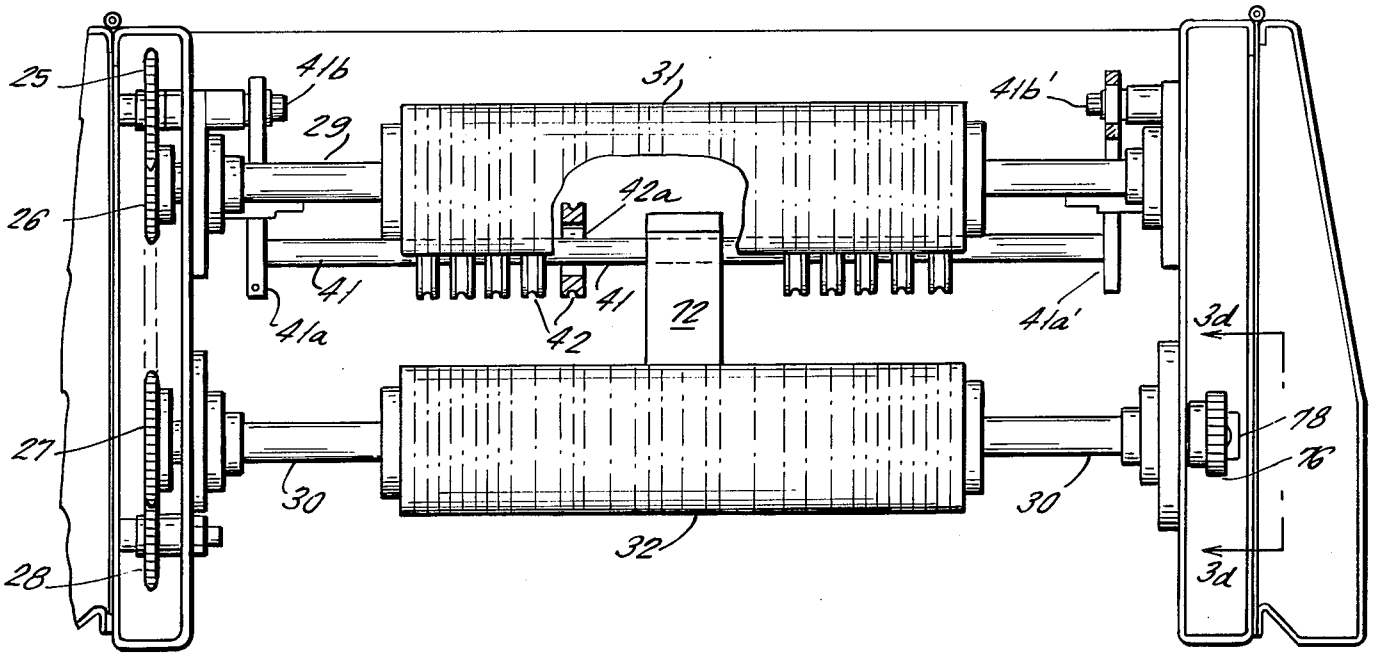

The infeed section 11 is shown in detail in FIGS. 3*a* -3*c* and is comprised of an infeed drive motor 21 for rotating a drive sprocket 22 coupled to the output shaft of a speed control mechanism 23 which, in turn, is coupled to the output shaft (not shown) of the infeed drive motor. A chain 24 is entrained about drive sprocket 22 and driven sprockets 25, 26, 27 and 28. Sprockets 26 and 27 are utilized for driving the conveyor belts (to be more fully described hereinbelow) employed in the upper and lower conveyor runs of the infeed section.

The right-hand end of the infeed section of FIG. 3*a* constitutes the upstream end of the infeed section and a view looking into the upstream end is shown in FIG. 3*c*. The sprockets 26 and 27 of FIG. 3*a* are also shown at the left-hand end of FIG 3*c*. These sprockets are respectively locked to free-wheelingly rotatable shafts 29 and 30 upon which the rollers 31 and 32 are mounted.

The downstream end of the infeed section is provided with cooperating V-roller assemblies 33 and 34 respectively. FIG. 3*b* shows a detailed view of these V-shaped roller assemblies looking generally in the direction from the downstream end toward the upstream end of the infeed section. Roller 31 cooperates with the upper V-shaped roller assembly 33 which, in FIG. 3*b*, can be seen to be comprised of two separate rollers 33*a* and 33*b* and which are mounted for rotation upon shafts 35 and 36 respectively. Roller 32 cooperates with the lower V-shaped roller assembly 34 which likewise is comprised of a pair of rollers 34*a* and 34*b* each being respectively mounted upon a shaft 37 bent into a V-shaped configuration.

Since all of the rollers 33*a* -33*b* and 34*a* -34*b* are substantially identical, only one of said rollers, i.e. roller 33*b*, has been shown in sectional fashion. Spring-like belts 39 are entrained about rollers 31 and 33*b*, said belts being retained in grooves such as, for example, the grooves 40 of roller 33*b*. Similar grooves are provided in each of the other rollers so as to properly seat the spring-like belts and maintain the belts in substantially spaced parallel fashion. A shaft 41 (see FIGS. 3*a* and 3*c*) which is further provided to mount paper counter 72 (to be more fully described) is positioned intermediate roller 31 and V-roller 33 and is provided with a plurality of individual disc-like rollers 42 arranged at spaced intervals along shaft 41 and free-wheelingly mounted thereupon by bearing assemblies 42*a*. As can best be seen from FIG. 3*a*, the spring-like belts engage to grooves of these rollers along their upper surfaces.

As shown best in FIG. 3*a*, similar type spring-like belts 43 are entrained about lower roller 32 (note also FIG. 3*c*) and an intermediate roller 44 mounted to freewheelingly rotate about stationary shaft 48. Additional spring-like belts 45 are entrained about selected grooves within intermediate roller 44 and aligned grooves provided in the lower V-roller assembly comprised of rollers 34*a*, 34*b*. Roller 44 is shown in FIG. 3*b* as being partially broken away to expose the V-shaped roller assemblies.

As can be seen from FIG. 3*a*, the lower run of belts 39 and the upper run of belts 43 taper toward one another until belts 39 move into engagement with the region of roller 44. Moving downstream therefrom it can be seen that the upper run of belts 45 and the lower run of belts 39 are in substantially engaged or closely arranged positions so as to substantially squeeze incoming signatures passing therebetween, causing trapped air to be squeezed out of the signatures.

The orientation of the upper and lower V-roller assemblies and the relative positioning therebetween is provided by means of a pair of lever arms 46 and 47 mounted about stationary shaft 48 (upon which roller 44 is mounted) and each having pivot pins 46*a* and 47*a* provided near their free ends, which pins receive collars 48 and 49 secured to piston rods 50 and 51 of pneumatically operated cylinders 52 and 53 whose upper ends are pivotally mounted by bifurcated elements 54 and 55 to stationary shaft 56. Thus, by controlling the air pressure applied between inlets 52*a* and 52*b* shown in FIG. 3*a*, the raising and lowering and hence adjustment of the downstream end of the infeed section is accomplished.

In order to control the squeezing force imparted between the upper and lower V-roller assemblies 33 and 34, additional piston operated means are provided. These piston operated means comprise cylinders 58 and 59 secured by brackets 60 and 61 to the cross-piece 62 extending between pivotally mounted arms 46 and 47. These cylinders are provided with piston rods 63 and 64 whose free ends are provided with collars 65 and 66 for securement to the opposite ends 67*a* and 67*b* of the swingable shaft employed for mounting the lower V-rollers 34*a* and 34*b*. The ends 67*a* and 67*b* of the shaft for rollers 34*a* and 34*b* are mounted to the free ends of arms A1 and A2. By appropriate regulation of the air pressure applied to cylinders 58 and 59, the squeezing force applied by the V-shaped roller assemblies 33 and 34 upon the incoming signature stream may be simply and accurately regulated. This arrangement has the distinct advantage over biasing spring means in that the squeezing pressure applied is more linear than the squeezng pressure that would otherwise be applied through the use of biasing springs extended between shaft ends 67*a* and 67*b* and cross-piece 62 since such springs have been found to exert a non-linear squeezing force as a function of changing thickness of the signatures.

The V-roller assemblies 33 and 34 impart a similar V-shaped configuration to the signatures as they pass between these rollers which serves to impart a significantly increased stiffness to the signatures thereby greatly facilitating the interception, stacking and bundle forming operations.

The signature counter 72, shown best in FIGS. 3*a* and 3*c*, may be of any suitable type adapted for counting signatures and capable of providing an accurate count therefor even in applications where a high rate of signatures per hour is being fed into the stacker. For example, in stacking and counting newspapers, it is not uncommon to have the signature stream flow rate be of the order of 70,000 newspapers per hour, or greater. One suitable counter for this application may be of the type described in U.S. Pat. No. 3,702,925 issued Nov. 14, 1972. Since a detailed description of the counter is set forth therein, a similarly detailed description will be omitted herein for purposes of brevity, the disclosure of the signature counter being incorporated herein by reference thereto.

Paper counter 72 is provided with an opening 72*a* for clamping the paper counter to shaft 41 so as to orient the paper counter in order to place the projecting portion 72*b* of an intercept member in the path of moving signatures whereby the forward edge or spine of the signature engages the intercept member projection 72*b* to cause the intercept member to rotate and thereby cause the signature counter 72 to develop a signal or pulse representative of the passage of one signature. Paper counter 72 is electrically connected to mechanical, electromechanical or electronic accumulating counter means 79*a* (see FIG. 3*c*) for accumulating count pulses to develop an output signal representative of the desired bundle size, which output may be programmed, for example, by a punch paper tape, an electronic computer or other means to form any desired bundle size in any desired order.

As another alternative, the stacker may be provided with electronic counter and decoder means which may be set by a manually operable control knob such as, for example, one of the control knobs C′ of the control knob group C so as to continuously count, stack and hence form bundles of one uniform signature quantity. For example, the manually operable control C′ may be set to continuously form bundles each having 50 signatures, 75 signatures, 100 signatures, and so forth.

Figure 3D:
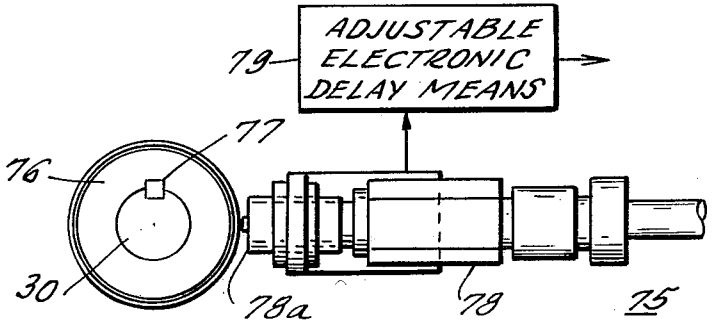

FIGS. 3*c* and 3*d* show a speed sensing means 75 comprised of a gear 76 locked by key means 77 to shaft 30, upon which roller 32 is mounted. Speed sensing member 78 is of a magnetic sensing type which generates output pulses as each gear tooth on gear 76 passes sensing head 78′positioned at a gap distance of the order of 0.025 inches from the outer diameter of the gear teeth on gear 76. These pulses are utilized to provide a positive indication of the rate of movement of the signature stream. Since paper counter 72 is located upstream relative to the intercept position, which will be described more fully hereinbelow, the speed sensing means 78 is utilized to regulate the delay time of adjustable electronic delay means 79 coupled to the speed sensing means to cause an intercept operation to occur at the proper time. For example, let it be assumed that the stacker is set up to form bundles each having 50 signatures. As the 50th signature passes and is counted by counter 72, it can be seen that it will take some finite period of time for the 50th signature to pass to the position of the intercept stop assembly 80 positioned immediately downstream of the V-shaped rollers 33 and 34. This finite period of time is obviously a function of the rate of flow of signatures through the infeed section and must be made adjustable to accommodate different speeds. This is accomplished by the speed sensing device 78 which senses the rate of angular movement of the gear teeth pass sensing head 78*a* to automatically adjust the adjustable electronic delay means 79 to pass an output pulse derived from accumulator 79*a* which pulse is delayed for a sufficient time period to allow the 50th signature to pass the intercept stop assembly 80 before this assembly is activated to allow the 50th signature to pass the intercept stop assembly and to then abruptly move the intercept blade assembly in front of the 51st signature to complete the last bundle and separate the next bundle to be formed from said last bundle. The specific operation of the intercept stop assembly and cooperating intercept blade assembly will be described hereinbelow.

Figure 2B:
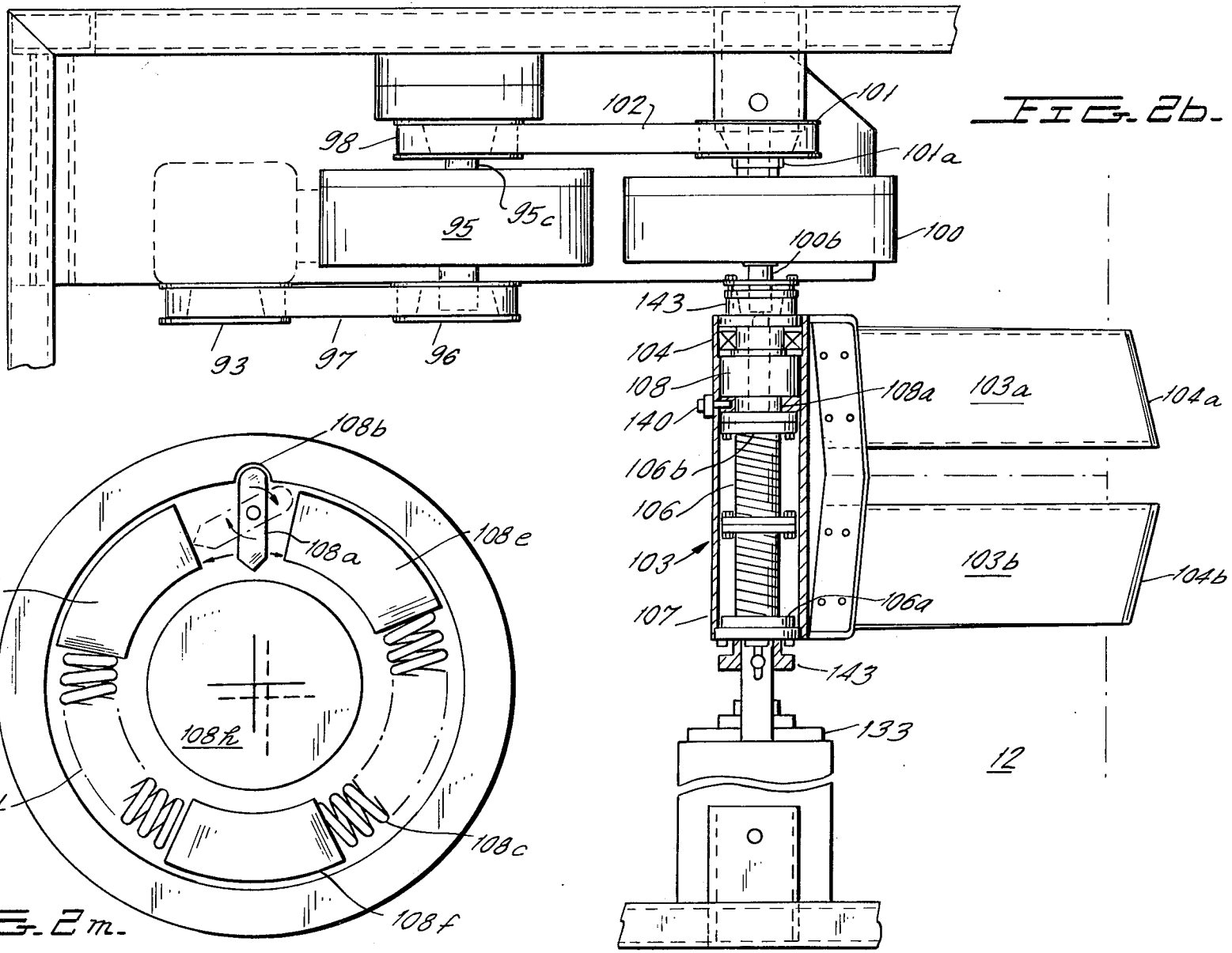
Figure 2M:
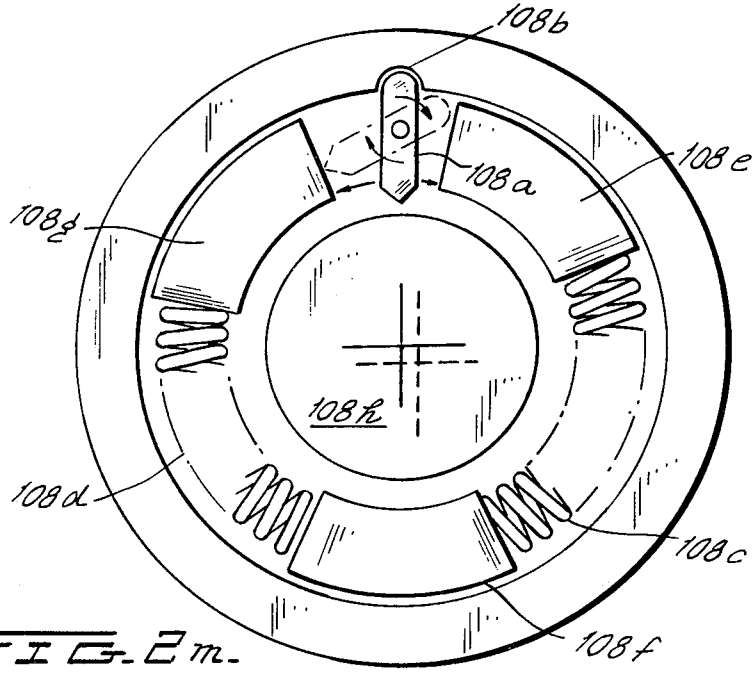
Figure 2A:
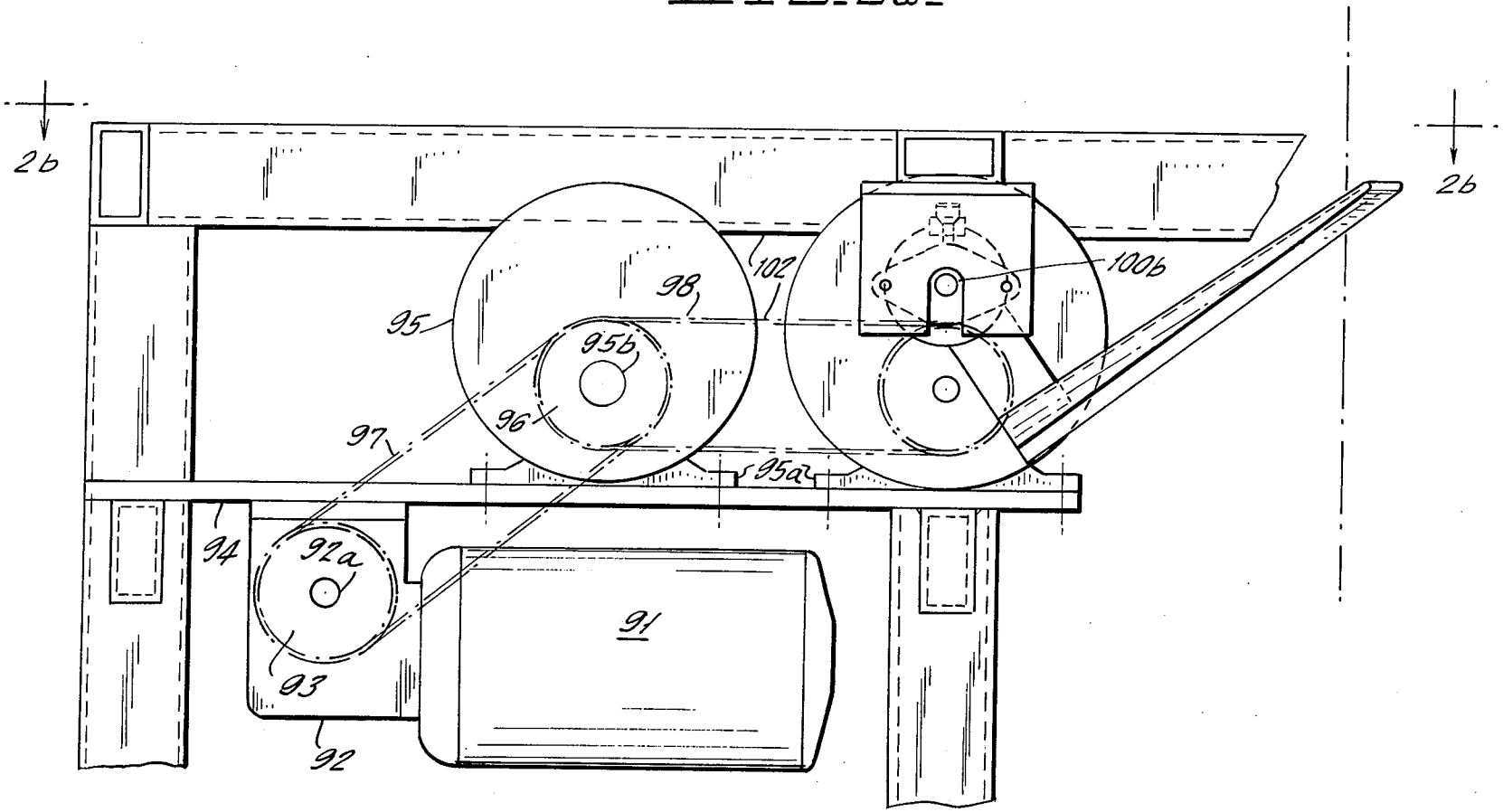

FIGS. 2*a* and 2*b* show elevational and top plan views of the intercept blade assembly 12 of FIG. 1*a*. This assembly is comprised of a three phase motor 91 whose output shaft 91*a* operates a worm gear assembly 92 having an input (coupled to the output of motor 91) and an output shaft 92*a*. Pulley 93 is mounted upon shaft 92*a*. Motor 91 and worm gear assembly 92 are firmly mounted upon a cross-piece member 94 of the stacker frame.

An intermittent drive unit 95 is provided with a bracket 95*a* to secure the drive unit to cross-piece 94 by suitable fastening means. The intermittent drive unit 95 is provided with an input or driven shaft 95*b* having a pulley 96 mounted thereon. A belt 97 is entrained about pulleys 93 and 96 so as to impart the rotation of pulley 93 to pulley 96 and hence so as to rotate shaft 95*b*. Motor 91 is continuously driven so that its output shaft is operating at an angular velocity sufficient to rotate pulley 93 and hence pulley 96 and shaft 95*b* at an angular velocity in excess of 100 rpm.

Figures 4A, 4B, 4C:
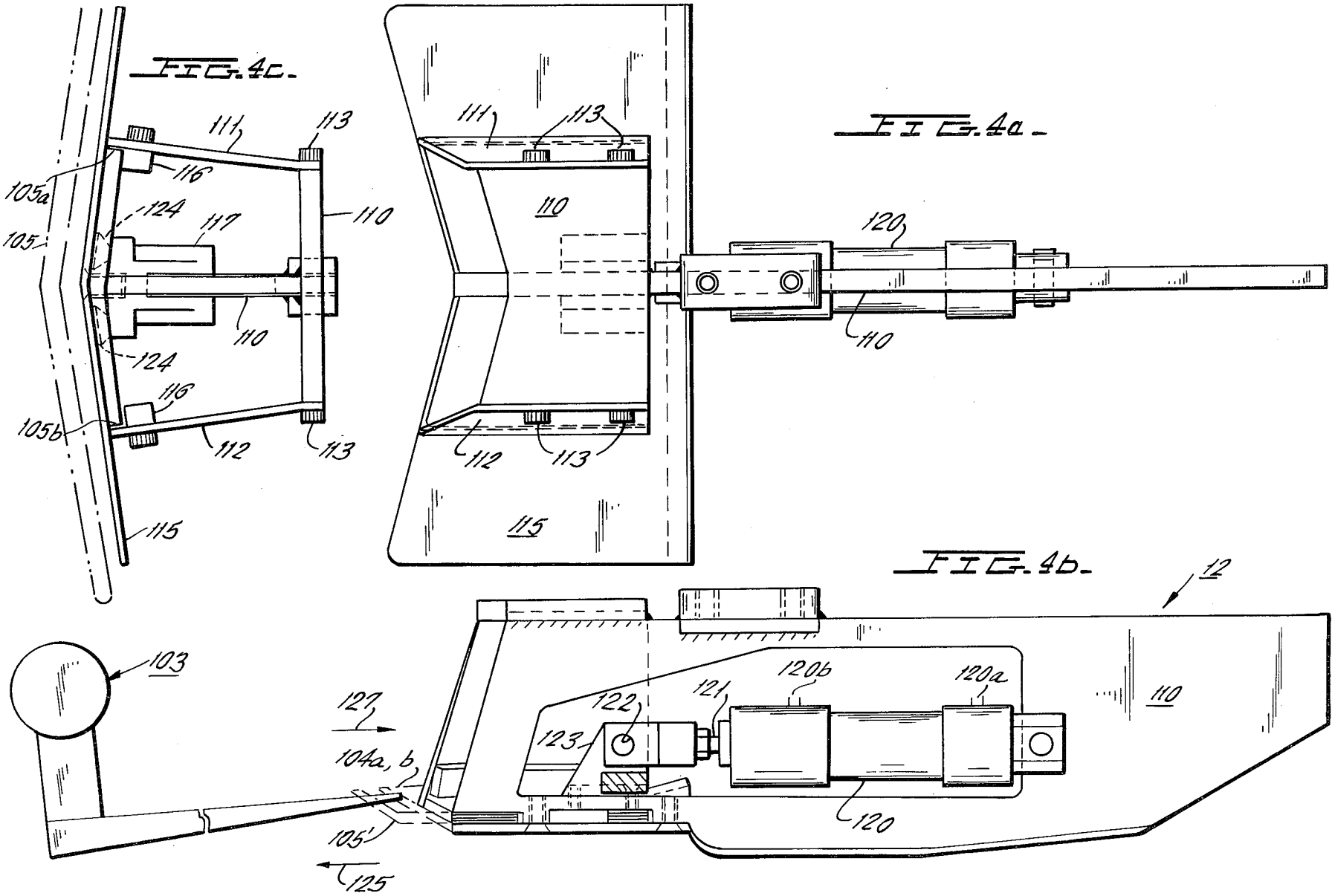
Figures 5A, 5B:
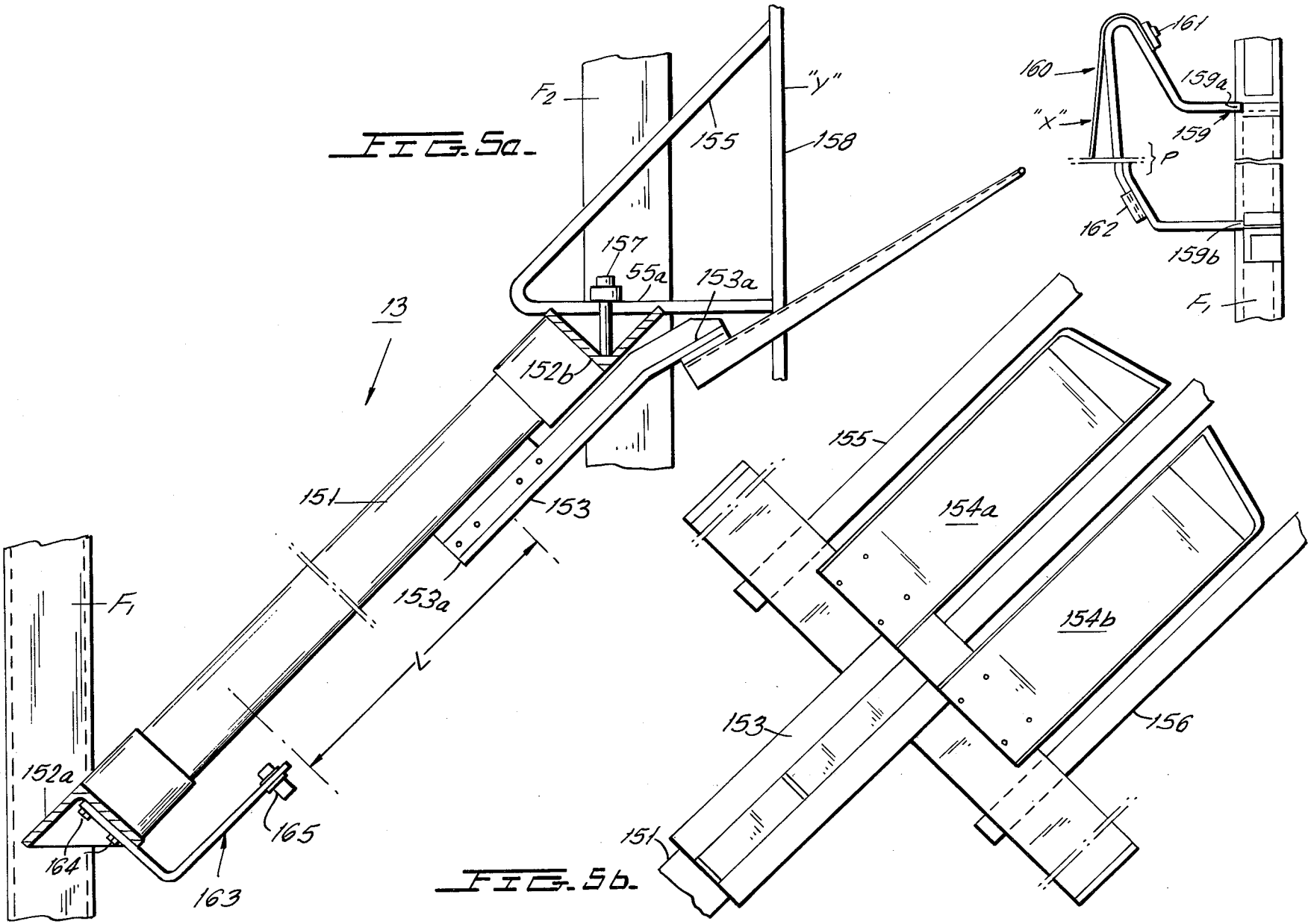

The solid state proximity sensor 165, shown in FIG. 5*a* is associated with the wingable intercept blade to develop a signal when the stacking blade is at the lowest point of travel. The delay circuit delays the pulse developed by the proximity sensor so that the pulse is not delivered to the single revolution clutch 95 unitl the stacking blade is on its way up. This pulse causes the single revolution clutch assembly 95 to rotate at a substantially constant angular velocity through exactly one full revolution. The single revolution clutch 95 is provided with an output shaft 95*c* upon which pulley 98 is mounted. Output shaft 95*c* and pulley 98 rotate through exactly one revolution, which rotation is imparted to the input shaft 100*a* of acceleration/deceleration unit 100 by means of pulley 101 mounted upon input shaft 100*a* and by means of timing belt 102 entrained about pulleys 98 and 101. Acceleration/deceleration unit 100 is provided with an output shaft 100*b* coupled to the intercept blades 103*a* and 103*b* of intercept assembly 103. Unit 100, through the output shaft 100*b*, rotates the intercept blades 103*a*–103*b* starting from almost zero velocity and smoothly and rapidly accelerates the intercept blades to approximately twice the input rpm imparted to input shaft 100*a* and then smoothly and rapidly decelerates the intercept blades down to zero velocity and then back up to about 10 percent of the input speed so that the tips 104*a* and 104*b* of the intercept blades come to substantially a complete stop when the tips arrive at the upper side of the reciprocating intercepting stop plate 105, shown best in FIGS. 3*a* and 4*a*–4*c*. The deceleration of the blade tips through zero velocity to slightly greater than zero velocity when the clutch 95 is deenergized upon completion of one full revolution causes spring loading of the blade assembly and prevents the breakage of plate 105 as well as the blade assembly, as will be more fully described. This operation is obtained by advancing the input shaft 100*a* of acceleration/deceleration unit 100 through a small angle relative to the output shaft 95*c* of single revolution clutch 95. The advancement angle is preferably of the order of 10°.

A suitable single revolution clutch assembly may be of the type manufactured by the Hilliard Corporation which is designated as an intermittent drive unit identified by the Model No. IDU-175 described in the Hilliard Bulletin IDU-3 dated February 1970. The unit receives an input pulse at input 95*e* from the delay means to become engaged and thereby abruptly raise the driven shaft 95*c* to full angular velocity almost instantaneously. The stopping point is inherently accurate within one-half of 1° without the need for special positive stop control. The acceleration/deceleration unit may be of the type identified by Model No. ADU-175 also described in the above-mentioned Hilliard Bulletin. This unit gradually and smoothly transmits the drive from the single revolution clutch assembly to its output shaft 100*b* until the output shaft reaches approximately twice the velocity of its input and then subsequently gradually and smoothly decelerates to zero angular velocity as the clutch assembly 95 nears the end of one full revolution.

The angular orientations of pulleys 98 and 101 are preferably adjusted so that pulley 101 is advanced approximately 15° from the zero acceleration position to preferably cause the intercept blade assembly 103 to start from a finite acceleration when clutch 95 is engaged, as opposed to starting from an absolute zero acceleration when the single revolution clutch is triggered to rotate through one complete revolution in order to be assured that the intercept blade tips 104*a* and 104*b* will move into the signature stream by an amount sufficient to provide positive and accurate interception of the signature stream.

The intercept blade assembly 103 is preloaded by means of a torsion spring 106 having end 106*a* secured to hollow cylinder 107 and having its opposite end 106*b* locked to the output end of safety clutch assembly 108 (to be more fully described).

Output shaft 100*b* advances through an angle sufficient to charge spring 106 so that tips 104*a* and 104*b* exert a force on the top of intercept stop plate 105 in a manner to be more fully described.

FIGS. 4*a* and 4*c* show top and end elevational views of the intercept stop assembly, while FIG. 4*b* shows a side elevational view thereof and further showing the cooperative relationship with the intercept blade assembly 103 and especially the blade tips 104*a* and 104*b*. The intercept stop assembly is mounted to cross-piece 62, is positioned immediately downstream of the V-shaped roller assemblies, and is comprised of an upper cross-piece 110 having a pair of substantially downwardly depending arms 111 and 112 secured to its opposite sides by fastening means 113. The lower ends of plates 111 and 112 support a substantially V-shaped plate 115 secured to plates 111 and 112 preferably by welding. A substantially V-shaped plastic plate 105 slides upon the upper surface of V-shaped metallic plate 115 and has its left and right-hand ends 105*a* and 105*b* lying immediately adjacent the interior sides of plates 111 and 112 (see FIG. 4*c*). Projections 116—116 serve as the upper slide guides for V-shaped plastic plate 105. The intercept assembly is further provided with an air cylinder 120 which reciprocally drives piston rod 121. The free end of piston rod 121 is provided with a pin 122 pivotally connected to member 123 whose lower end is secured to intercept stop plate 105 by fastening means 124 (note especially FIGS. 4*b* and 4*c*). Air under pressure coupled to input 120*a* drives the piston rod 121 and hence plate 105 in the direction shown by arrow 125 whereas air under pressure applied to input 120*b* drives intercept stop plate 105 in the reverse direction.

FIG. 4*b* shows the position of the intercept blade tips 104*a* and 104*b* and the intercept stop sheet 105' (in dotted fashion) just before the initiation of an intercept operation.

Application of air under pressure applied to input 120*b* moves sheet 105' in the direction shown by arrow 127. This moves stop 105' away from blade tips 104*a*–104*b*. At this time the acceleration/deceleration device 100 (see FIG. 2*b*) is not yet operated. Substantially simultaneously therewith, air under pressure is applied to input 52*b* of air cylinder 52, as shown in FIG. 3*a,* to lift the entire infeed assembly slightly in order to provide sufficient clearance between the lower surface of sheet 105 and the now unlatched blade tips 104*a*–104*b* to be assured that signatures and especially thick signatures have sufficient clearance to move beneath the intercept stop and on to the intercept blade. The free loaded torsion spring 106, shown best in FIG. 2*b,* assures abrupt movement of the blade tips 104*a*–104*b* through a small angle which, however, is sufficient, together with the upward movement of the downstream end of the infeed conveyor and hence of the intercept stop assembly 12 to intercept the signature stream and to allow the first few signatures to freely pass beneath plate 115 to be collected upon the intercept blades 103*a* and 103*b*. Preferably the blades move approximately one inch beneath the lower surface of sheet 105. Air cylinder 52 of FIG. 3*a* is operated by an electronic delay device which delays the pulse for triggering the air cylinder so that it becomes activated only after the spine of the first signature has moved a predetermined distance diagonally downward along the top surfaces of blades 103*a* and 103*b*. Thereafter, air under pressure is introduced into opening 120*a* to return the stop 105' to the extended position in readiness for the next intercept operation.

The maximum torque protection clutch assembly 108 shown best in FIGS. 2*b* and 2*m,* protects the intercept blades 103*a*–103*b* and the intercept stop 105 from being damaged or broken. The clutch assembly, which may preferably be of the type manufactured by HELLAND Research and Engineering, Inc. and identified by Model TT2X is provided with a rotatable pin 108*a* which fits into a cooperating recess 108*b* during normal operation. Due to the extremely high torque developed during movement of the intercept blade assembly from zero velocity toward twice the angular velocity of input pulley 101, if any signatures or other items should create a jam condition, the clutch assembly sensing means senses the overload torque condition and rotates the pin from its cooperating recess to compress springs 108*c,* 108*d* and release the shoes 108*e,* 108*f* and 108*g* from 108*h* to enable the intercept assembly to be completely free-wheeling relative to the output shaft 100*b* of acceleration/deceleration unit 100. An advantage of this design is in the simiplicity of the reset operation. Since there is very precise relationship between the angular alignment of shaft 100*b* and the position of blade tips 104*a*–104*b,* a simple friction clutch, while giving protection against a jam condition so as to slip before breakage of elements 103 and 105 would not have the simplified and yet precise reset arrangement of clutch assembly 108. The advantageous clutch assembly 108 permits the intercept blade assembly to be rotated by hand until the rotatable pin provided in the clutch assembly "clicks" into the cooperating recess. If, however, the stacker is accidentally turned on before resetting the blade assembly the high rotating speed will not provide the pin with sufficient time to "click" into position thereby preventing acceleration/deceleration unit 100, blade assembly 103 and stop 105 from being damaged.

Figures 2C, 2D, 2E, 2F, 2G, 2H, 2I, 2J, 2K:
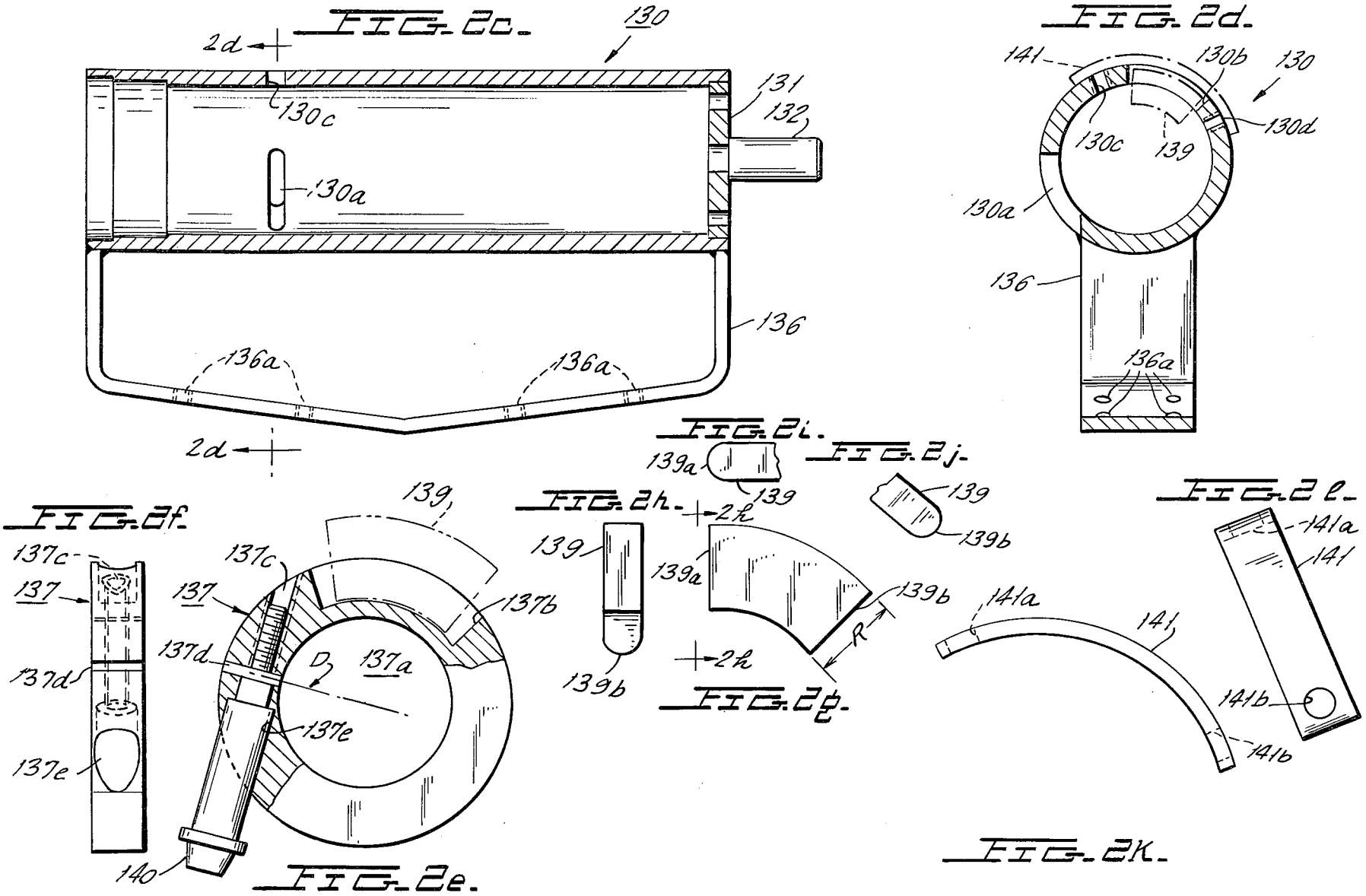

The pre-loading of torsion spring 106 is accomplished by an adjustable assembly, shown in fully assembled fashion in FIG. 2*a,* the elements of which are shown in the detailed drawings 2*b*–2*j*. FIGS. 2*c* and 2*d* show the hollow housing 130 for the intercept blade assembly. The right-hand end of the cylindrical housing is provided with a plate 131 preferably welded thereto for joining a short shaft section 132 thereto, which short shaft portion is free-wheelingly mounted within bearing assembly 133. The opposite interior end of the hollow cylindrical housing is adapted to seat a second bearing assembly 134. The housing is further provided with a pair of narrow slots 130*a* and 130*b* and with a pair of threaded openings 130*c* and 130*d* provided on opposite sides of slot 130*b*. A substantially U-shaped plate 136 is preferably welded to hollow housing 130 and is provided with threaded openings 136*a* for receiving threaded fasteners which secure blades 103*a* and 103*b* thereto.

A stop ring 137, shown best in FIGS. 2*b,* 2*e* and 2*f* is provided with a central opening 137*a,* an arcuate-shaped slot 137*b* and an elongated opening 137*c* arranged substantially perpendicular to one diameter D of member 137 and being tapped along its length. The ring member 137 is split at 137*d* and a second opening 137*e* is positioned in alignment with opening 137*c* on the opposite side of slit 137*d*. Central opening 137*a* is fitted around the bulb 108*a* of clutch assembly 108 which, in turn, has its input end coupled to the output shaft 100*b* of the acceleration/deceleration 100. Slot 137*b* receives a brake pad comprised of an arcuate-shaped nylon insert 139 shown best in FIGS. 2*g*–2*j*. FIG. 2*h* shows the arcuate-shaped brake pad 139 looking in the direction of arrows 2*h*—2*h* of FIG. 2*g*. As can best be seen in FIGS. 2*i* and 2*j* the left and right-hand ends 139*a* and 139*b* of pad 139 have rounded ends.

Preferably brake pad 139 is a substantially 45° section and is fitted within slot 137*b* of member 137 (FIG. 2*e* ) having an arcuate length of the order of 60° . Thus, brake pad 139 fits loosely within slot 137*b*. However, the brake pad fits snuggly within the slot 130*b* of housing 130 (note especially FIG. 2*d* ), the length R of the brake pad measured in the radial direction being sufficient to enable the brake pad to extend into slots 137*b* and 130*b*.

The split clamped stop ring 137 is designed to be releasably clamped upon the output hub portion 108*a* of clutch assembly 108. The split clamp assembly is adapted to be adjustably tightened upon the hub by fastener means 140 which extends through opening 137*e* (see FIG. 2*e* ) and threadedly engages the tapped hole 137*c*. The arcuate slot 130*b* in hollow housing 130 (FIG. 2*d*) is sealed by means of an arcuate-shaped pad holder 141, shown best in FIGS. 2*k* and 2*l,* which pad is provided with openings 141*a* and 141*b* for receiving threaded fasteners to seal slot 130*b* and thereby retain pad 139 in position.

By loosening threaded fastener 140, it is possible to rotate stop ring 137 relative to the hub 108*a* thereby enabling the housing 130 to be moved relative to hub 108 to adjust the spring tension exerted by torsion spring 106 upon the housing, the amount of "play" or adjustment being provided as a result of the relative arcuate dimensions of slot 137*b* (FIG. 2*e*) and brake pad 139 (FIG. 2*g*).

A one-way clutch assembly 143 is designed to prevent the intercept blade assembly from being rotated counterclockwise (relative to FIG. 4*b*) about its axis of rotation while permitting the intercept blade to rotate clockwise. This feature assures the fact that when the nylon sheet 105' (note FIG. 4*b*) is moved in the direction of arrow 127, that the intercept blade tips 104*a*–104*b,* after moving downwardly, are prevented from bouncing or rebounding to then move upwardly. The operation of the intercept stop and intercept blade assembly is such that the first device to operate is the air cylinder 120 of FIG. 4*b* which moves the intercept stop away from a holding position beneath the intercept blade tips 104*a*–104*b,* causing the blade tips to move abruptly downwardly due to the preloading of the blade assembly by torsion spring 106. The pre-loaded of torsion spring is further charged by the advancement of the input shaft 100*a* of the acceleration/deceleration unit 100 relative to the output shaft 95*c* of one-revolution clutch 95 as was described hereinabove. The unit 100 thus causes the blade tips to decelerate to zero velocity and then accelerate to a slight amount in rotating through an angle of approximately 10°–15° before clutch 95 completes one full revolution so as to load torsion spring even more than the pre-loading applied thereto since the blade tips are arrested from swinging through the 10°–15° angle by the blade stop 105. At this time, however, neither the one revolution clutch assembly 95 nor the acceleration/deceleration unit 100 has been activated. Thus, the one-way clutch assembly 143 prevents the blade assembly from "bouncing" or rebouding which might otherwise cause the blade tips to move into and then out of the stream of signatures.

The air cylinder 52, shown in FIG. 3*a,* is then activated by applying air under pressure to opening 52*b* causing the downstream end of the infeed section comprised of the V-shaped roller assemblies and hence the intercept stop assembly 12 to move upwardly more than one inch to provide sufficient clearance for a thick signature to pass beneath plate 115 (FIG. 4*c*) and upon blades 103*a*–103*b.*

Thereafter a pulse is applied to one revolution clutch assembly 95 causing the acceleration/deceleration unit 100 to smoothly drive the intercept blade assembly from almost zero velocity up to a maximum angular velocity of the order of twice the angular velocity of its input shaft 100*a* causing several signatures to be temporarily held upon the blades of the intercept blade assembly whereupon rapid acceleration toward approximately twice the input angular velocity of the acceleration/deceleration unit causes the intercept blade assembly to "drop out" from beneath the temporarily held signatures so as to enable these signatures to drop downwardly towards the stacking blade assembly 13 of FIG. 1*a,* to be described hereinbelow in greater detail in connection with FIGS. 5*a* and 5*b.*

The stacking blade assembly 13 is comprised of an air cylinder 151 mounted by angle brackets 152*a* and 152*b* to upright member F1 and F2 of the stacker supporting frame. The air cylinder has its piston member (not shown) mounted to a bracket 153 which is bent slightly downwardly at its free end 153*a* and which is employed for the purpose of mounting a pair of blade members 154*a* and 154*b* comprising the stacking blade assembly. A plurality of substantially V-shaped backstop supports 155 and 156 have their arms 155*a* (only one of which is shown in FIG. 5*a*) secured to braket arm 152*b* by fastening means 157. The forward ends of these arms secured (preferably by welding) to spaced parallel elongated backstop members so that the stacking blades 154*a* and 154*b* are interspersed therebetween.

Another vertical support F3 of the stacker frame has mounted thereto a spring supporting bracket 159 whose arms 159*a* and 159*b* are secured to upright F3. It should be noted that the portion P of the supporting bracket 159 has been broken away (i.e. removed) so as to incorporate the entire structure within the figure and that this structure is significantly greater in length whereby its upper end is in close proximity to the intercept stop means and its lower end is of the order of 14 inches below its upper end.

A resilient spring-like member 160 is bent at both its upper and lower ends and fastening means 161 and 162 are provided for joining these bent ends to spring mounting bracket 159.

The operation of the stacking blade assembly 13 is as follows:

The stacking blade is maintained in the upright position shown in FIG. 5*a.* Let it be assumed that the intercept blade assembly 103 has already temporarily held back several of the signatures delivered thereto and has rotated so as to drop these signatures on to the tops of stacking blades 154*a* and 154*b.* As the signatures drop down and are deposited on the stacking blades their spines or forward folded edges fall against the backstop members 158. Resilient spring-like member 160 serves to urge the back or cut edges of the signatures generally downwardly and to the left to urge the spines towards the backstop thereby forming substantially neat signature stacks upon the stacking blades.

Let it be assumed that a bundle of 50 signatures is being formed. At some point well prior to the deposit of the 50th signature upon the supporting stacking blades 154*a*–154*b,* the intercept blade tips 104*a*–104b will have been reset so as to be pressing downwardly upon intercept stop 105 by torsion spring 106. Counter means 72 (see FIG. 3*a*) and a cooperating speed sensing means 75 and adjustable electronic delay means 79 and accumulator 79*a* operate to release the intercept stops from the blade tips 104*a*–104*b* so that torsion spring 106 abruptly moves the blade tips into the signature stream just as the forward folded edge or spine of the 50th signature has passed beneath the blade tips, but before the spine of the 51st signature has arrived so that the 51st signature will be diverted so as to move along the top surfaces of blades 103*a* and 103*b* while the 50 th signature will be free to move toward and be stacked upon stacking blades 154*a* and 154*b.* As soon as the 50th signature is deposited upon the signature bundle being formed, air cylinder 151 is activated to move the stacking blades downwardly and to the left over a distance represented by stroke length L whereupon the blades move downwardly and to the left of backstop members 158 causing the bundle to fall substantially straight down and upon a bundle receiving bucket forming part of the table assembly 14, shown in FIG. 1*a* and to be described more fully hereinbelow.

An L-shaped bracket 163 is secured to angle arm 152*a* by fastening means 164 and has a magnetic sensing device 165 mounted at its free end for the purpose of detecting the presence of the bottom end of 153*a* of bracket 153 indicating that the stacking blade assembly has reached the bottom-most limit of its downward stroke and thereby causing the air pressure applied to air cylinder 151 to be reversed so as to move the stacking blade assembly to its upper-most limit. The timing of the stacking blade assembly 13 and intercept blade assembly 12 is such that the intercept blade assembly 103 temporarily holds enough signatures for a sufficient length of time to enable the stacking blade assembly to drop out from beneath the formed bundle to allow it to fall downwardly into the bundle receiving bucket and to permit the stacking blade assembly to return to its uppermost position before the "51st" signature and several following signatures are released from the intercept blades 103*a* and 103*b* to drop upon stacking blades 154*a* and 154*b*.

Figure 6A:
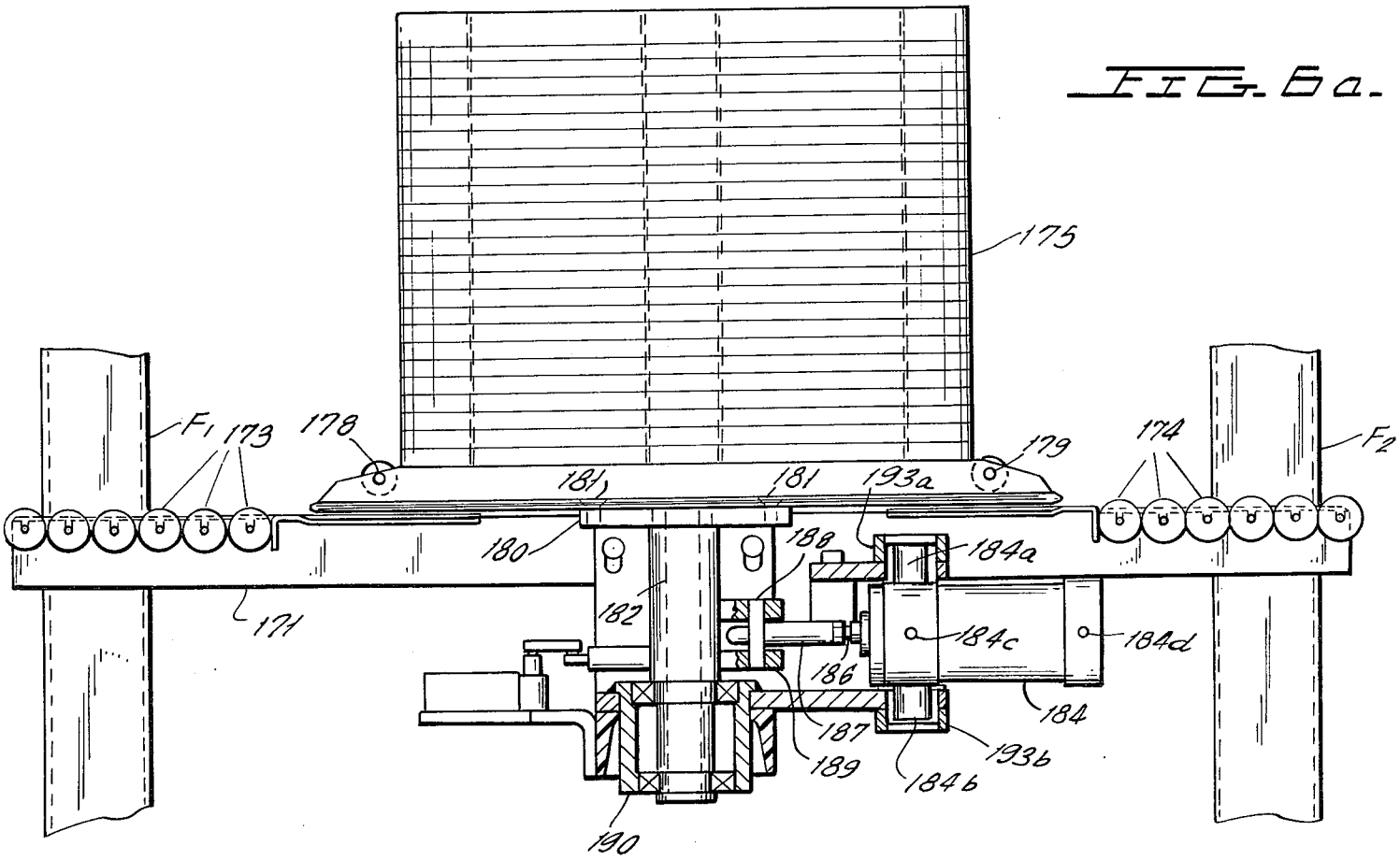
Figure 6B:
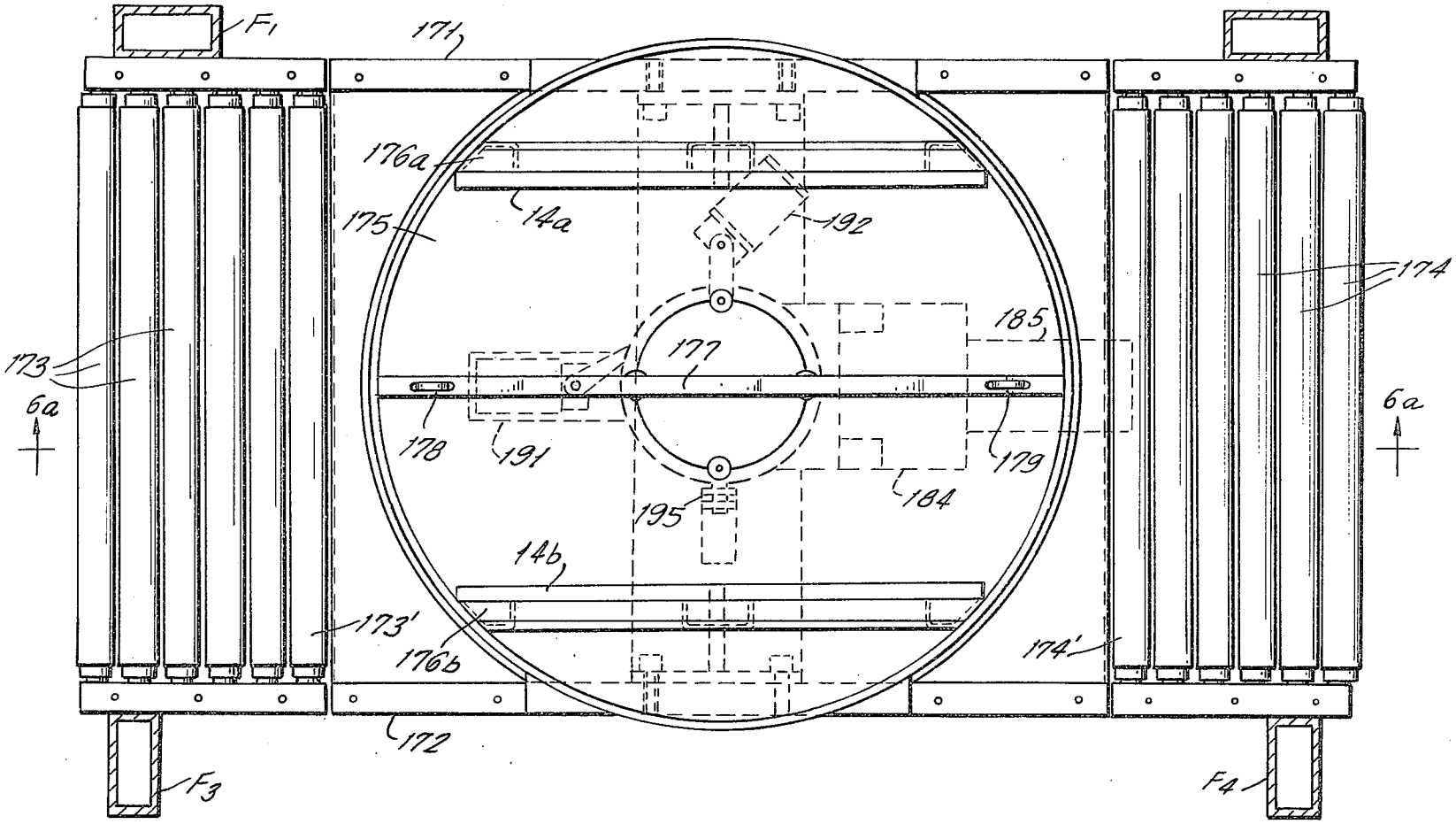

FIGS. 6*a* and 6*b* show the turntable and bundle holding bucket assembly 14. The support frame members F1–F2 and F3–F4 have secured thereto a pair of elongated angle arms 171 and 172, the left and right-hand end portions of which are adapted to free-wheelingly mount a plurality of rollers 173 and 174. Positioned between angle arms 171 and 172 and the rollers 173' and 174' is a turntable assembly comprised of a disc-shaped turntable or base 175 supporting a pair of upright sides 14*a* and 14*b* which are vertically corrugated and are mounted to base 175 by angle arms 176*a* and 176*b* respectively. The gap distance between the side walls 14*a* and 14*b* is dimensioned so as to receive a signature therebetween with the signature lying substantially flat except for the elongated bar 177 mounted along one diameter of base 175 and provided with free-wheelingly mounted rollers 178 and 179 near its tapered left and right-hand ends (see FIG. 6*a*). The elongated bar 177 and rollers 178 and 179 serve to facilitate pushing off of a completed bundle onto either of the short conveyor sections 173 and 174 in a manner to be more fully described.

The base 175 is supported by a plate 180 secured thereto by fastening means 181, which plate, in turn, is welded to the upper end of a rotatable shaft 182 driven by air cylinder 184 mounted beneath base 175 and secured by suitable means to the cross-pieces 171 and 172 supporting the turn-table assembly. Air cylinder 184 is provided with a piston member 186 coupled through a link arm 187 to a pin 188 mounted within a bifurcated bracket 189 secured to shaft 182. The bottom of shaft 182 is mounted for free-wheeling rotation within bearing assembly 190.

When stacking uncompensated bundles, the turntable assembly is maintained stationary throughout the stacking operation whereupon signatures are dropped into the holding bucket and pushed out of the bucket by the pusher arm assembly to be more fully described.

However, let it be assumed that a compensated bundle of 50 signatures is desired. Initially, 25 signatures all having their spines, for example, positioned adjacent side wall 14*b* (see FIG. 6*b*) will be deposited into the holding bucket. Thereafter, air cylinder 184 is activated to rapidly rotate shaft 182 and hence the turntable base 175 through an angle of 180°. In this respect it should be noted that air cylinder 184 is provided with upper and lower cylindrical projections 184*a* and 184*b* mounted within cylindrical-shaped sockets 193*a* and 193*b* to permit the air cylinder and its drive piston to "swing" during the rotating operation. Air switch 191 senses the 90° point of travel to reverse the air pressure in air cylinder ports 184*c*, 184*d*, causing the piston rod 186 to be extended from the cylinder 184 causing the turntable 175 to turn through an additional 90° angle. FIG. 6*a* shows the air cylinder 184 in the 90° position. Air switch 191 is shown as being activated to initiate rotation of the turntable through an additional 90° angle. Air switch 192 serves to interlock the turning cylinder and the pusher cylinder 201 to prevent movement of the pusher arms until the turntable has completed rotation through a half-revolution. Sensing device 195 functions to provide a signal which is coupled to an alarm device in the event that air cylinder 184 is activated and the turntable fails to rotate so as to enable the rapid turn off of the stacker and illumination or activation of an audio and/or visual alarm.

Once the turntable has rotated through a 180° angle, the spines of the first 25 signatures lying adjacent side wall 14*b* will now be rotated through 180° whereupon the next 25 signatures delivered into the holding bucket will have their spines resting against side wall 14*a* to thereby provide a compensated bundle of 50 signatures. The side walls 14*a* and 14*b* are corrugated so as to prevent any of the signatures from "riding up" along the side walls as the turntable rapidly rotates during operations in which compensating bundles are being formed.

Figures 7A, 7B, 7C:
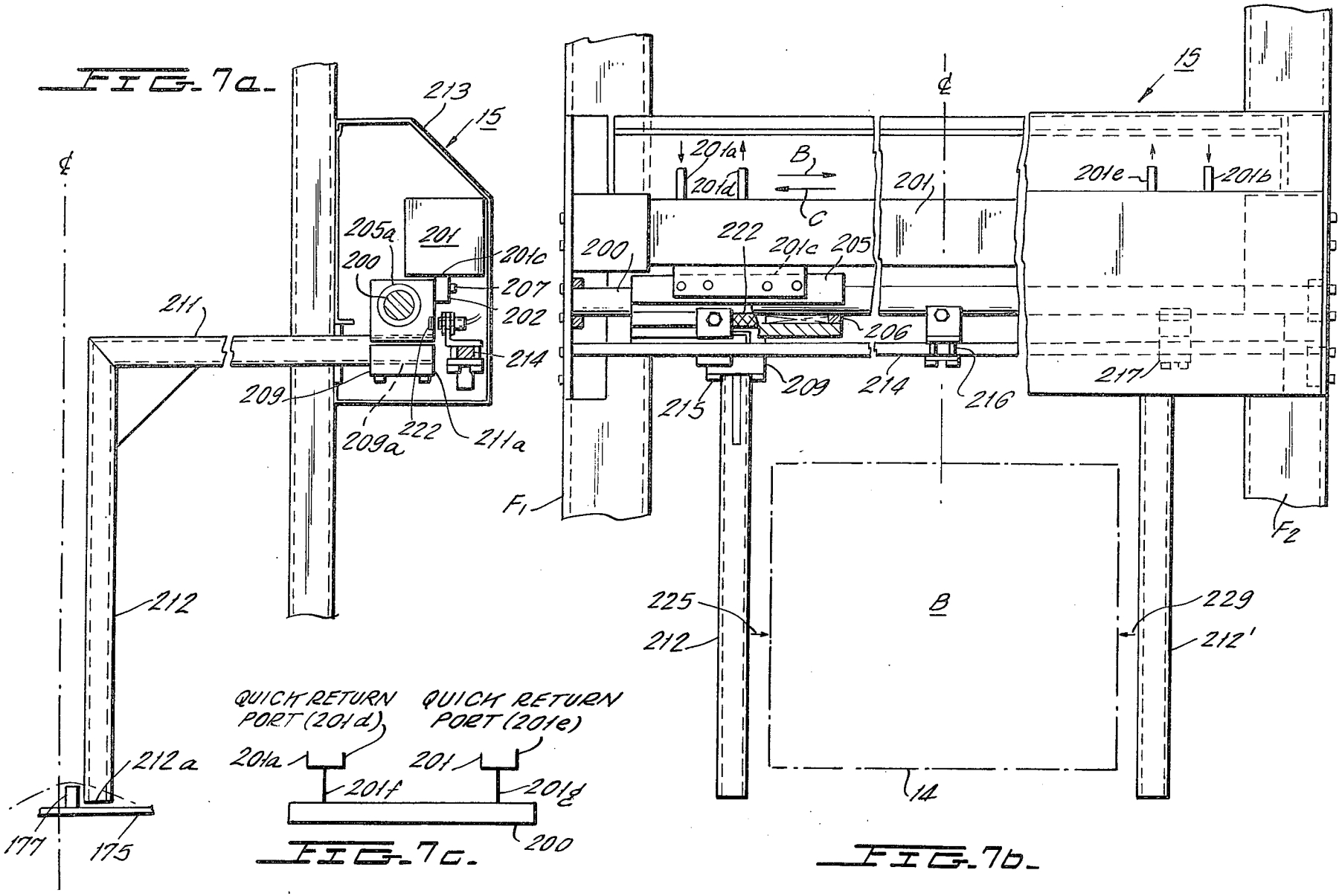

The pusher assembly 15 is shown best in FIGS. 7*a* and 7*b* and is comprised of a rigid, hardened guide shaft 200 rigidly secured between the arm portions of frame uprights F1 and F2. The shaft assures parallel movement of the pusher assembly (to be more fully described) and avoids excessive cantilever or torque forces. Above shaft 200 is an air cylinder structure 201 whose opposite ends are mounted to the arms of frame uprights F1 and F2, said cylinder being provided with air pressure inlets 201*a* and 201*b* and normally closed release ports 201*d* and 201*e* (to be more fully described). The air cylinder is provided with an internally mounted piston assembly (not shown in detail) whose projection 202 extends downwardly through an elongated slot provided along the entire axial length of the cylindrical-shaped barrel of air cylinder 201. The axial slot is provided with a sliding air-tight seal movable over the entire length of the air cylinder to prevent the escape of air under pressure which is used to move the piston in reciprocal fashion between its extreme left and right-hand limits of travel. It should be noted that housing 201 is stationary while the piston mounted therein moves between the extreme end points. The air cylinder employed herein is preferably an ORIGA cylinder manufactured by ORIGA CYLINDER A.B. of Sweden. The distinct advantage of this type of air cylinder and piston assembly is that it permits movement of the piston over a distance which is nearly that of the overall length of the cylinder.

An elongated rigid block 205 is provided with a bore 205*a* into which is fitted a bearing assembbly 206 to provide a very low friction sliding engagement between shaft 200 and block 205. The upper end of block 205 is provided with tapped openings for receiving fasteners 207 to secure the piston projection 201*a* thereto. Thus, any movement imparted to the piston is coupled through projection 201*a* to block 205 causing it to reciprocate between the end points of travel.

A second rigid block 209 is fastened to the underside of block 205, said blocks having substantially square-shaped slots 205*b* and 209*a* respectively, which cooperatively define a substantially rectangular-shaped opening for receiving the upper free end 211*a* of pusher assembly horizontal arm 211 which is secured to the vertically aligned pusher arm 212 at a mitred joint 211*a* which may be formed, for example, by welding. The lower end 212*a* of vertically aligned pusher arm 212 is slightly above the turntable base 175 below the top surface of rod 177 to facilitate a positive pushing operation, as will be more fully described hereinbelow.

An elongated removable housing 213 encloses all of the elements of the pusher arm assembly, including the air cylinder 201, shaft 200, blocks 205 and 209 and an elongated cross-piece 214 upon which are mounted first, second and third magnetic sensing devices 215, 216 and 217 for controlling the sequence of the pushing operations. The elongated housing is provided with an elongated slot 213*a* to permit the unimpeded movement of horizontally aligned pusher arm 211.

The operation of the pusher assembly is as follows:

Let it be assumed that the veritcally aligned pusher arm 212 is in its left-hand-most position (relative to FIG. 7*b*) and that a completed bundle B is in the holding bucket of turntable assembly 14. As soon as the bundle has been completed, air under pressure is introduced into opening 201*a* and against one side of the internal piston while air of a substantially reduced pressure (but greater than zero pressure) is maintained on the opposite side of the piston due to the small size of opening 201*b* causing the pusher arm to move in the direction shown by arrow 225 whereupon the vertically aligned pusher arm 212 pushes against the side edges S1 of bundle B to move the bundle in the same direction.

In order to be assured that the entire bundle will be pushed out of the holding bucket and that the bottom-most signature in the bundle will neither be left in the holding bucket nor be subjected to any tearing, bar 177 raises the central portion of the bottom-most signature, and hence the signatures thereabove, as spaced distance from the top surface of turntable base 175 sufficient to assure that the bottom edge of the bottom-most signature will be higher than the bottom of the pusher arm so as to be engaged by the lower end 212*a* of pusher arm 212 to assure that the entire bundle is pushed from the turntable. The rollers 178 and 179 (see FIGS. 6*a* and 6*b*) make rolling engagement with the bottom surface of the bottom-most signature to prevent any drag between the ends of elongated bar 177 and the bottom-most signature as the bundle is moved out of the holding bucket.

The three proximity sensing switches 215, 216 and 217 cooperate with a magnetic strip 222 affixed to the confronting surface of rigid block 205 and cooperate with electronic circuitry to monitor and control the operation of the pusher assembly and the turntable. For example, when the pusher arm 212 is positioned as shown in FIG. 7*b* and a bundle B is to be pushed in the direction shown by arrow 225. Proximity sensor 215 develops a signal indicating that the pusher arm 212 is in the correct position enabling a pushing operation in direction 225 to be initiated. The pusher arm pushes the bundle B in the direction shown by arrow 225. The piston continues to move in direction 225 until it hits the end of the assembly. The pressure applied to the appropriate port is sustained until the arm is to be moved in the opposite direction. Pusher arm 212 is now in a position 212' which places it in readiness for pushing the next bundle in the opposite direction, as shown by arrow 229. Proximity switch 217 assures that the pusher arm 212' is in the correct position for pushing a bundle toward the left applying air under pressure to opening 201*b* and reducing the air pressure to port 201*a.* The pusher arm moves until the piston hits the opposite end of the cylinder. The pressure applied to port 201*b* is sustained until the next pushing operation is initiated. This arrangement can be seen to be quite satisfactory for pushing alternating bundles in the alternating direction 225 and 229.

However, let it be assumed that the bundles are only to be pushed in one direction or, alternatively, that two or more successively formed bundles are to be pushed in the same direction. Let it further be assumed that pusher arm 212 is in the solid line position shown in FIG. 7*b.* Starting at the left-hand position, sensor 215 detects the position of the block 205 by means of magnetic strip 222 assuring that the pusher arm 212 is in the proper position (and it should further be noted that this assures that the pusher arm is out of the way of the turntable to permit rotation of the turntable during the formation of compensated bundles). At this time, air under pressure is applied into inlet 201*a* while air under pressure is being let out through port 201*a.* This causes pusher arm 212 to move in the direction shown by arrow 225 to move bundle B to the right.

As soon as proximity switch 216 detects the presence of magnetic strip 222, air under pressure is removed from inlet 201*a* and air of greater pressure is applied to inlet opening 201*b.* In addition thereto, a normally closed auxiliary escape orifice 201*d* is opened so that the pressure to the left-hand side of the piston mounted within air cylinder 201 substantially collapses causing pusher arm 212 to move to a point intermediate proximity switches 216 and 217 to abruptly come to a stop and to be moved in the reverse direction shown by arrow 229 at a rate more rapid than it moves in the direction of arrow 225 so as to return to the solid line position 212 very rapidly in readiness for pushing the next successive bundle to the right. Ports 201*a* and 201*d* are actually coupled in common to one port 201*f* of the cylinder 201 as shown best in FIG. 7*c.* The port 201*f* of the cylinder is connected in common to ports 201*a* and 201*d* by means of a T-connection. One end of the T-connection has a normally closed outlet exit which opens to provide an additional escape route for the air being released from the cylinder. Ports 201*b* and 201*e* are connected to cylinder port 201*g* in a similar fashion. It should be understood that ports 201*e* and 201*d* remain closed when the bundles are being pushed out of opposite sides of the stacker in an alternating fashion.

The operation is substantially the same for cases in which successive bundles are to be pushed in the direction of arrow 229. With the pusher arm in the dotted line position 212, proximity sensor 217 senses the presence of magnetic strip 222 enabling the turntable to rotate (if compensated bundles are being formed) and subsequent thereto enabling air under pressure to be applied to inlet 201*b* pushing a bundle B in the direction shown by arrow 229. Proximity switch 216 detects the presence of magnetic strip 222 causing air under pressure to be applied into inlet 201*a* and opening quick return air escape orifice 201*e* whereupon the pusher arm rapidly decelerates to a stop at a position intermediate proximity switches 215 and 216, rapidly reverses its direction and then moves toward the dotted line position 212' at a rate more rapid than the movement of pusher arm 212 in the direction shown by arrow 229 to rapidly reset pusher arm 212 in readiness for pushing the next bundle in the direction shown by arrow 229. Each turntable rotation utilizes either sensor 215 or 216 to prevent initiation of rotation until the pusher arm has cleared the turntable and especially the side walls 14*a* and 14*b.*

It can be seen from the foregoing description that the present invention provides a novel stacker assembly in which the need for plural stacking buckets and/or temporary signature clamping means has been completely eliminated through the use of a novel cooperating intercept blade and intercept stop assembly which is adapted to rapidly move into the incoming signature stream to assure completion of the last bundle of an accurate count and to hold up at least several of the signatures temporarily deposited upon the intercept blade for a period of time sufficient to enable a reciprocating stacking blade assembly to release a formed bundle (or bundle portion) from the stacking blade assembly, which bundle drops into the holding bucket, and return to its uppermost position in readiness for receipt of the several signatures temporarily held up by the intercept blade assembly, as well as the succeeding signatures which make up the next bundle. The intercept blade assembly, after temporarily holding up several of the signatures deposited thereon, rapidly accelerates to a high angular velocity so as to "drop out" from beneath the temporarily supported signatures permitting them to be deposited upon the stacking blade assemblies whereupon the intercept blade assembly continues through one complete revolution with the acceleration/deceleration unit 100 being adapted to decelerate the intercept blade assembly to substantially zero angular velocity as the intercept blade assembly completes its one full revolution so that the intercept blade assembly does not damage or break the now extended intercept stop member 105.

A novel pusher assembly is provided wherein proximity switches, in conjunction with electrical control means permits preprogramming of completed bundles to enable successive bundles to be pushed out in the same direction, in alternating directions and in any regular or irregular pattern, said proximity switches further serving to assure that the pusher arm is clear of the turntable assembly to enable rotation of the turntable assembly during stacking operations in which compensated bundles are being formed as soon as the pusher arm is clear of the turntable.

A novel upper and lower V-roller assembly is provided in the stacker infeed section to compress the signature stream passing therethrough so as to serve the dual functions of pressing any air out of the signature streams and gently bending the signatures into a substantially V-shaped configuration to impart stiffness to the signatures which greatly facilitates the intercept operation as well as facilitating movement of the signatures for deposit upon the stacking blade assembly.

Although there has been described a preferred embodiment of this novel invention, many variations and modifications will now be apparent to those skilled in the art. Therefore, this invention is to be limited, not by the specific disclosure herein, but only by the appending claims.

We claim:

1. A stacker for forming bundles containing a preselected number of signatures from an incoming signature stream delivered to the stacker with the signatures arranged in overlapping fashion, said stacker comprising infeed conveyor means for receiving said signature stream;

an outfeed location means;

swingable blade means including a blade assembly having tips movable across the downstream end of said infeed conveyor means to intercept said stream;

reciprocating stop means for normally preventing said tips from moving in the path of the signature stream as the signatures leave the infeed conveyor means when said stop means is in an extended position;

preloading means for biasing said blade means in a first direction and against said stop means;

means positioned in said infeed conveyor means for counting said signatures to generate a trigger signal upon reaching a count representative of the desired bundle size;

reciprocating means positioned beneath said blade means for stacking signatures delivered from said conveyor means and blade means to form a bundle when in the collection position and dropping the formed bundle upon said outfeed location means positioned therebeneath when in the withdrawn position;

drive means responsive to said trigger signal to move said stop means to a withdrawn position displaced away from said blade tips into said stream for temporarily collecting a quantity of signatures on said blade means for a period sufficient to permit the said receiving means to complete its operation;

means for thereafter rapidly rotating said blade assembly from a rest condition through substantially one full revolution and back to said rest condition to deposit the signatures temporarily held thereon to said receiving means and return said blade tips to the position above said stop means and being urged against the stop means by said preloading means in readiness for the next intercept operation;

said rotating means including means for moving said assembly at a faster rate during the intermediate portion of each revolution to move the blades from beneath the signatures deposited thereon so that the signatures undergo free-fall to be deposited upon said reciprocating means.

2. The stacker of claim 1, wherein said drive means further includes means for moving said stop means to the extended position before said blade means completes one revolution to thereby prevent said blade means tips from moving into said stream until the next trigger signal is received.

3. The stacker of claim 1, wherein said infeed conveyor means further comprises a pair of cooperating rollers defining the downstream end of said infeed conveyor means;

means for swingably mounting said pair of rollers;

means for rotating said rollers to cause said rollers to urge signatures passing therebetween towards said stacking means;

means coupled to said swingable mounting means for lifting said pair of rollers upwardly when said stop means is in the withdrawn position to increase the gap between said blade tips and said stop means to facilitate the passage of signatures passing beneath said stop means and being temporarily collected upon said blade means.

4. The stacker of claim 3, wherein said swingable mounting means further comprises first and second pivotally mounted arms each adapted to swing about a stationary pivot point;

each of said rollers being rotatably mounted between the free swingable ends of an associated pair of arms;

air cylinder means mounted between said first and second pairs of swingable arms for urging said rollers towards one another to squeeze signatures passing therebetween, the urging force exerted upon said rollers being substantially constant even in the case where the spacing between the first and second pairs of arms changes with changes in thickness of the signature stream.

5. The stacker of claim 4 wherein said downstream infeed rollers each have a substantially V-shaped configuration for imparting a similar shape to signatures passing therebetween to stiffen the signatures and thereby facilitate handling and stacking of the signatures.

6. The stacker of claim 1 wherein said rotating means is comprised of motor means;

single revolution clutch means having an input shaft coupled to said motor means; and an output shaft;

acceleration/deceleration means coupled to said clutch means output shaft and having an output shaft coupled to said blade means;

said clutch means including means responsive to said trigger signal for abruptly accelerating its output shaft to a constant angular velocity an maintaining rotation at said constant angular velocity and abruptly halting rotation of its output shaft upon completion of one full revolution;

said acceleration/deceleration means comprising means responsive to rotation of said clutch means output shaft for smoothly and gradually accelerating its output shaft from zero velocity towards an angular velocity of the order of twice its input velocity and thereafter smoothly and gradually decelerating its output shaft so as to bring its output shaft substantially to zero velocity as the output shaft completes one full revolution.

7. The stacker of claim 1 further comprising backstop means;

said stacking means comprising reciprocally mounted stacking blade means having an upper position extending through said backstop means and cooperating with said backstop means to receive and collect signatures from either said blade means or said infeed conveyor means;

said stacking blade means further having a lower position displaced from said backstop means to enable signatures deposited and collected thereon to be transferred to a bundle collecting table positioned beneath said upper position;

means for moving said stacking blade means to said lower position and rapidly return said stacking blade means to said upper position in readiness for receipt of the next bundle.

8. The stacker of claim 7, wherein said collecting table further comprises rotatably mounted turntable means;

means for rotating said turntable to form compensated bundles.

9. The stacker of claim 8 further comprising pusher means including a pusher arm and air driven cylinder means for reciprocally moving said pusher arm along a horizontal path between first and second end points to push completed bundles out of said turntable.

10. The stacker of claim 9 wherein said cylinder means comprises means for moving said pusher arm in a first direction at a first velocity when pushing a bundle out of said turntable and for moving said pusher arm in the reverse direction at a second faster velocity of return said pusher arm to its original position in readiness for pushing the next bundle in said first position.

11. The stacker of claim 10 further comprising first and second proximity sensing means positioned adjacent the end points of travel of said pusher arm for respectively detecting the position of said pusher arm to permit rotation of said turntable only when said pusher arm is at one of said end points.

12. The stacker of claim 11 further comprising third proximity sensing means positioned intermediate the end points of travel of said pusher arm and responsive to said pusher arm passing thereby for generating a signal;

said cylinder means being adapted to reverse said pusher arm when said pusher arm passes said third sensing means.

13. The stacker of claim 12, wherein said pusher arm air cylinder comprises first and second air ports positioned at opposite ends of said air cylinder, T-connector means for coupling a source of pressure to each port and first and second normally closed quick air release ports further coupled to said air cylinder ports and adapted to be selectively open when moving said pusher arm in said reverse direction to facilitate movement of the pusher arm at a faster velocity.

14. The stacker of claim 6, wherein the coupling between the output shaft of said single revolution clutch means and the acceleration/deceleration means is adjusted to cause the blade means to decelerate to zero velocity and then to accelerate a predetermined amount before said single revolution clutch means is deenergized.

15. The stacker of claim 1, further comprising one-way clutch means coupled between said blade assembly and said rotating means for preventing any rebounding of said blade means in a direction opposite said first direction upon movement of said stop means towards said withdrawn position.

16. The stacker of claim 1 further comprising maximum torque protection clutch means coupled between said blade assembly and said rotating means for disengaging the driving force of said rotating means from said blade assembly when the driving force exerted by said rotating means exceeds a predetermined threshold.

17. The stacker of claim 16 wherein said clutch means comprises a driving output shaft; retractable pin means; a hollow cylinder surrounding said output shaft and having a recess for receiving said retractable pin; means normally engaging said outfeed shaft for rotating said output shaft when said cylinder is rotated, to drive said blade assembly when said pin is seated within said opening;

said means being responsive to a maximum torque threshold condition for withdrawing from said opening and releasing said shaft engaging means to enable said cylinder to be free-wheeling relative to the shaft to thereby prevent said blade assembly and said stop means from being damaged.

18. The stacker of claim 17, wherein said pin means is prevented from entering said recess when the relative rotation between said pin and said cylinder exceeds a predetermined angular velocity to prevent said blade means from being rotated when the angular velocity imparted to the clutch means is too high.

19. The conveyor means of claim 1 wherein said infeed conveyor means comprises a first upper conveyor means;

a first lower conveyor means positioned beneath said upper conveyor means;

the lower run of said upper conveyor means being diagonally aligned to form a tapered infeed region with the upper run of said first lower conveyor means for receiving said signature stream;

second upper conveyor means postioned adjacent the downstream end of said first upper conveyor means;

second lower conveyor means positioned adjacent the downstream end of said first lower conveyor means, whereby the lower run of said second downstream upper conveyor means and the upper run of said second downstream lower conveyor means are adapted to receive said signature stream therebetween;

the downstream end of said second upper and lower conveyor means comprising:

a pair of cooperating rollers defining the downstream end of said infeed conveyor means;

means for swingably mounting said pair of rollers;

means for rotating said rollers to cause said rollers to compress the signatures passing therebetween;

means coupled to said swingable mounting means for lifting said pair of rollers upwardly when said stop means is in the withdrawn position to increase the gap between said blade tips and said stop means to facilitate the passage of signatures passing beneath said stop means and being temporarily collected upon said blade means.

20. The conveyor means of claim 19, wherein said swingable mounting means comprises first and second pivotally mounted arms each adapted to swing about a stationary pivot point;

each of said rollers being rotatably mounted between the free swingable ends of an associated pair of arms;

air cylinder means mounted between said first and second pairs of swingable arms for urging said rollers towards one another to squeeze signatures passing therebetween, the urging force exerted upon said rollers being substantially linear and independent of the spacing between said rollers.

21. The conveyor means of claim 20, wherein said infeed rollers each have a substantially V-shaped configuration for imparting a similar shape to signatures passing therebetween to facilitate handling and stacking of the signatures.

22. A turntable assembly for receiving and stacking a bundle of signatures delivered thereto from an intermediate stacking means comprising:

means for rotating said turntable assembly;

pusher means including a pusher arm and air driven cylinder means for reciprocally moving said pusher arm along a horizontal path between first and second end points to selectively push completed bundles in either direction; said cylinder means being positioned above said turntable assembly and between said end points.

23. The device of claim 22, wherein said cylinder means comprises means for moving said pusher arm in a first direction at a first velocity when pushing a bundle out of said turntable and for moving said pusher arm in the reverse direction at a second faster velocity to return said pusher arm to its original position in readiness for pushing the next bundle in said first direction.

24. The device of claim 23 further comprising first and second proximity sensing means positioned adjacent the end points of travel of said pusher arm for respectively detecting the position of said pusher arm to permit rotation of said turntable only when said pusher arm is at one of said end points.

25. The device of claim 24 further comprising third proximity sensing means positioned intermediate the end points of travel of said pusher arm and responsive to said pusher arm passing thereby for generating a signal;

said cylinder means being adapted to reverse said pusher arm when said pusher arm passes said third sensing means.

26. The device of claim 25 wherein said pusher arm air cylinder comprises first and second air ports positioned at opposite ends of said air cylinder, T-connector means for coupling a source of pressure to each port and first and second normally closed quick air release ports further coupled to said air cylinder ports and adapted to be selectively open when moving said pusher arm in said reverse direction to facilitate movement of the pusher arm at a faster velocity.

* * * * *